US007075239B2

(12) United States Patent
Kang et al.

(10) Patent No.: US 7,075,239 B2
(45) Date of Patent: Jul. 11, 2006

(54) METHOD AND APPARATUS FOR DRIVING PLASMA DISPLAY PANEL USING SELECTIVE WRITE AND SELECTIVE ERASE

(75) Inventors: Seong Ho Kang, Taegu-shi (KR); Jang Hwan Cho, Kumi-shi (KR); Gop Sick Kim, Kumi-shi (KR); Eung Gwan Lee, Taegu-shi (KR)

(73) Assignee: LG Electronics Inc., Seoul (KR)

( * ) Notice: Subject to any disclaimer, the term of this patent is extended or adjusted under 35 U.S.C. 154(b) by 186 days.

(21) Appl. No.: 10/325,835

(22) Filed: Dec. 23, 2002

(65) Prior Publication Data

US 2003/0201726 A1 Oct. 30, 2003

Related U.S. Application Data

(63) Continuation-in-part of application No. 09/803,993, filed on Mar. 13, 2001, now Pat. No. 6,653,795.

(30) Foreign Application Priority Data

| | | |
|---|---|---|
| Mar. 14, 2000 | (KR) | 00-12669 |
| Sep. 7, 2000 | (KR) | 00-53214 |
| Jan. 18, 2001 | (KR) | 01-3003 |
| Feb. 9, 2001 | (KR) | 01-6492 |

(51) Int. Cl.
*G09G 3/10* (2006.01)
*G09G 3/12* (2006.01)

(52) U.S. Cl. ..... 315/169.3; 345/36

(58) Field of Classification Search ..... 315/169.1, 315/169.2, 169.3, 169.4; 345/36, 41, 45, 345/51, 53, 204, 208, 690, 698

See application file for complete search history.

(56) References Cited

U.S. PATENT DOCUMENTS

| | | | | |
|---|---|---|---|---|
| 5,663,741 | A | 9/1997 | Kanazawa | 345/66 |
| 5,854,540 | A * | 12/1998 | Matsumoto et al. | 315/169.1 |
| 5,874,932 | A * | 2/1999 | Nagaoka et al. | 345/60 |
| 6,211,867 | B1 | 4/2001 | Kim | 345/211 |
| 6,281,635 | B1 * | 8/2001 | Lee | 315/169.4 |
| 6,335,712 | B1 * | 1/2002 | Kim | 345/60 |
| 6,335,728 | B1 | 1/2002 | Kida et al. | 345/204 |
| 6,344,841 | B1 | 2/2002 | Moon | 345/60 |
| 6,356,249 | B1 | 3/2002 | Lim | 345/66 |
| 6,362,800 | B1 * | 3/2002 | Moon | 345/60 |

FOREIGN PATENT DOCUMENTS

| | | |
|---|---|---|
| EP | 0834856 A1 | 4/1998 |
| EP | 0834856 A | 4/1998 |
| FR | 2740253 A | 4/1997 |
| FR | 02740253 | 4/1997 |
| FR | 2755281 | 4/1998 |
| FR | 2755281 A | 4/1998 |

* cited by examiner

*Primary Examiner*—Tuyet Vo
*Assistant Examiner*—Minh Dieu A
(74) *Attorney, Agent, or Firm*—Fleshner & Kim, LLP

(57) ABSTRACT

There is explained a method and apparatus of driving a plasma display panel that is capable of increasing a driving margin upon a selective writing and a selective erasing in case that not only the selective writing but also the selective erasing are carried out within one frame period.

A method of driving a plasma display panel that selects cells in use of selective writing sub-fields and selective erasing sub-fields arranged within one frame period and has a plurality of scanning electrodes, a plurality of sustaining electrodes and a plurality of address electrodes, according to an embodiment of the present invention includes steps of selecting an on-cell by generating a writing discharge in use of a first scanning voltage in the selective writing sub-fields; and selecting an off-cell by generating an erasing discharge in use of a second scanning voltage in the selective erasing sub-fields.

59 Claims, 12 Drawing Sheets

METHOD AND APPARATUS FOR DRIVING PLASMA DISPLAY PANEL USING SELECTIVE WRITE AND SELECTIVE ERASE

This application is a Continuation-In-Part of U.S. application Ser. No. 09/803,993, filed Mar. 13, 2001, now U.S. Pat. No. 6,653,795, the specification of which is hereby incorporated by reference.

BACKGROUND OF THE INVENTION

1. Field of the Invention

This invention relates to a method and apparatus of driving a plasma display panel, and more particularly to a method and apparatus of driving a plasma display panel that is capable of driving a plasma display panel at a higher speed as well as improving the contrast. Further, this invention relates to the method and apparatus of driving the plasma display panel that is adaptive to carrying out not only selective write but also selective erase in a predetermined period, that is capable of increasing a driving margin upon the selective write and selective erase and making an initialization stable upon the selective erase in the event that the selective write and the selective erase are all carried out in one frame period.

2. Description of the Related Art

Generally, a plasma display panel (PDP) radiates a phosphorus by an ultraviolet with a wavelength of 147 nm generated during a discharge of He+Xe or Ne+Xe gas to thereby display a picture including characters and graphics. Such a PDP is easy to be made into a thin-film and large-dimension type. Moreover, the PDP provides a very improved picture quality owing to a recent technical development. Particularly, a three-electrode, alternating current (AC) surface-discharge type PDP has advantages of a low-voltage driving and a long life in that it can lower a voltage required for a discharge using wall charges accumulated on the surface thereof during the discharge and protect the electrodes from a sputtering caused by the discharge.

Referring to FIG. 1, a discharge cell of the three-electrode, AC surface-discharge PDP includes a scanning electrode 30Y and a sustaining electrode 30Z formed on an upper substrate 10, and an address electrode 20X formed on a lower substrate 18.

The scanning electrode 30Y and the sustaining electrode 30Z include a transparent electrode 12Y or 12Z, and a metal bus electrode 13Y or 13Z having a smaller line width than the transparent electrode 12Y or 12Z and provided at one edge of the transparent electrode, respectively. The transparent electrodes 12Y and 12Z are formed from indium-tin-oxide (ITO) on the upper substrate 10. The metal bus electrodes 13Y and 13Z are formed from a metal such as chrome (Cr), etc. on the transparent electrodes 12Y and 12Z so as to reduce a voltage drop caused by the transparent electrodes 12Y and 12Z having a high resistance. On the upper substrate 10 provided with the scanning electrode 30Y and the sustaining electrode 30Z, an upper dielectric layer 14 and a protective film 16 are disposed. Wall charges generated upon plasma discharge are accumulated in the upper dielectric layer 14. The protective film 16 protects the upper dielectric layer 14 from a sputtering generated during the plasma discharge and improves the emission efficiency of secondary electrons. This protective film 16 is usually made from MgO. The address electrode 20X is formed in a direction crossing the scanning electrode 30Y and the sustaining electrode 30Z. A lower dielectric layer 22 and barrier ribs 24 are formed on the lower substrate 18 provided with the address electrode 20X. A phosphorus layer 26 is coated on the surfaces of the lower dielectric layer 22 and the harrier ribs 24. The barrier ribs 24 are formed in parallel to the address electrode 20X to divide the discharge cell physically and prevent an ultraviolet ray and a visible light generated by the discharge from being leaked into the adjacent discharge cells. The phosphorus layer 26 is excited and radiated by an ultraviolet ray generated upon plasma discharge to produce a red, green or blue color visible light ray. An inactive mixture gas, such as He+Xe or Ne+Xe, for a gas discharge is injected into a discharge space defined between the upper/lower substrate 10 and 18 and the barrier ribs 24.

Such a three-electrode AC surface-discharge PDP drives one frame, which is divided into various sub-fields having a different emission frequency, so as to realize gray levels of a picture. Each sub-field is again divided into a reset period for uniformly causing a discharge, an address period for selecting the discharge cell and a sustaining period for realizing the gray levels depending on the discharge frequency. When it is intended to display a picture of 256 gray levels, a frame period equal to 1/60 second (i.e. 16.67 msec) in each discharge cell 1 is divided into 8 sub-fields SF1 to SF8 as shown in FIG. 2. Each of the 8 sub-field SF1 to SF8 is divided into a reset period, an address period and a sustaining period. The reset period and the address period of each sub-field are equal every sub-field, whereas the sustaining period and the discharge frequency are increased at a ration of $2^n$ (wherein n=0, 1, 2, 3, 4, 5, 6 and 7) at each sub-field. Since the sustaining period becomes different at each sub-field as mentioned above, the gray levels of a picture can be realized.

Such a PDP driving method is largely classified into a selective writing system and a selective erasing system depending on an emission of the discharge cell selected by the address discharge.

The selective writing system turns off the full screen in the reset period and thereafter turns on the discharge cells selected by the address discharge. In the sustaining period, a discharge of the discharge cells selected by the address discharge is sustained to display a picture.

In the selective writing system, a scanning pulse applied to the scanning electrode 30Y has a pulse width set at 3 μs or more to form sufficient wall charges within the discharge cell.

If the PDP has a resolution of VGA (video graphics array) class, it has total 480 scanning lines. Accordingly, in the selective writing system, an address period within one frame requires total 11.52 ms when one frame period (i.e., 16.67 ms) includes 8 sub-fields. On the other hand, a sustaining period is assigned to 3.05 ms in consideration of a vertical synchronizing signal Vsync. Herein, the address period is calculated by 3 μs (a pulse width of the scanning pulse)×480 lines×8(the number of sub-fields) per frame. The sustaining period is a time value (i.e., 16.67 ms−11.52 ms−0.3 ms−1 ms−0.8 ms) subtracting an address period of 11.52 ms, once reset period of 0.3 ms, and an extra time of the vertical synchronizing signal Vsync of 1 ms and an erasure period of 100 μs×8 sub-fields from one frame period of 16.67 ms.

The PDP may generate a pseudo contour noise from a moving picture because of its characteristic realizing the gray levels of the picture by a combination of sub-fields. If the pseudo contour noise is generated, then a pseudo contour emerges on the screen to deteriorate a picture display quality. For instance, if the screen is moved to the left after the left half of the screen was displayed by a gray level value of 128 and the right half of the screen was displayed by a gray level value of 127, a peak white, that is, a white stripe emerges at a boundary portion between the gray level values 127 and 128. To the contrary, if the screen is moved to the right after the left half thereof was displayed by a gray level value of 128 and the right half thereof was displayed by a gray level value of 127, then a black level, that is, a black stripe emerges on at a boundary portion between the gray level values 127 and 128.

In order to eliminate a pseudo contour noise of a moving picture, there has been suggested a scheme of dividing one sub-field to add one or two sub-fields, a scheme of re-arranging the sequence of sub-fields, a scheme of adding the sub-fields and re-arranging the sequence of sub-fields, and an error diffusion method, etc. However, in the selective writing system, the sustaining period becomes insufficient or fails to be assigned if the sub-fields are added so as to eliminate a pseudo contour noise of a moving picture. For instance, in the selective writing system, two sub-fields of the 8 sub-fields are divided such that one frame includes 10 sub-fields, the display period, that is, the sustaining period becomes absolutely insufficient. If one frame includes 10 sub-fields, the address period becomes 14.4 ms, which is calculated by 3 μs (a pulse width of the scanning pulse)×480 lines×10(the number of sub-fields) per frame. On the other hand, the sustaining period becomes −0.03 ms (i.e., 16.67 ms−14.4 ms−0.3 ms−1 ms−1 ms) which is a time value subtracting an address period of 14.4 ms, once reset period of 0.3 ms, an erasure period of 100 μs×10 sub-fields and an extra time of the vertical synchronizing signal Vsync of 1 ms from one frame period of 16.67 ms.

In such a selective writing system, a sustaining period of about 3 ms can be assured when one frame consists of 8 sub-fields, whereas it becomes impossible to assure a time for the sustaining period when one frame consists of 10 sub-fields. In order to overcome this problem, there has been suggested a scheme of divisionally driving one field, However, such a scheme raises another problem of a rise of manufacturing cost because it requires an addition of driver IC's.

A contrast characteristic of the selective writing system is as follows. In the selective writing system, when one frame consists of 8 sub-fields, a light of about 300 cd/m$^2$ corresponding to a brightness of the peak white is produced if a field continues to be turned on in the entire sustaining period of 3.05 ms. On the other hand, if the field is sustained in a state of being turned on only in once reset period and being turned off in the remaining period within one frame, a light of about 0.7 cd/m$^2$ corresponding to the black is produced. Accordingly, a darkroom contrast ratio in the selective writing system has a level of 430:1.

The selective erasing system makes a writing discharge of the full screen in the reset period and thereafter turns off the discharge cells selected in the address period. Then, in the sustaining periods, only the discharge cells having not selected by the address discharge are sustaining-discharged to display a picture.

In the selective erasing system, a selective erasing data pulse with a pulse width of about 1 μs is applied to the address electrode 20X so that it can erase wall charges and space charges of the discharge cells selected during the address discharge. At the same time, a scanning pulse with a pulse width of 1 μs synchronized with the selective erasing data pulse is applied to the scanning electrode 30Y.

In the selective writing system, if the PDP has a resolution of VGA (video graphics array) class, then an address period within one frame requires only total 3.84 ms when one frame period (i.e., 16.67 ms) consists of 8 sub-fields. On the other hand, a sustaining period can be sufficiently assigned to about 10.73 ms in consideration of a vertical synchronizing signal Vsync. Herein, the address period is calculated by 1 μs (a pulse width of the scanning pulse)×480 lines×8(the number of sub-fields) per frame. The sustaining period is a time value (i.e., 16.67 ms−3.84 ms−0.3 ms−1 ms−0.8 ms) subtracting an address period of 3.84 ms, once reset period of 0.3 ms, and an extra time of the vertical synchronizing signal Vsync of 1 ms and an entire writing time of 100 μs×8 sub-fields from one frame period of 16.67 ms. In such a selective erasing system, since the address period is small, the sustaining period as a display period can be assured even though the number of sub-fields is enlarged. If the number of sub-fields SF1 to SF1 within one frame is enlarged into ten as shown in FIG. 3, then the address period becomes 4.8 ms calculated by 1 μs (a pulse width of the scanning pulse)×480 lines×10(the number of sub-fields) per frame. On the other hand, the sustaining period becomes 9.57 ms which is a time value (i.e., 16.67 ms−4.8 ms−0.3 ms−1 ms−1 ms) subtracting an address period of 4.8 ms, once reset period of 0.3 ms, an extra time of the vertical synchronizing signal Vsync of 1 ms and the entire writing time of 100 μs×10 sub-fields from one frame period of 16.67 ms. Accordingly, the selective erasing system can assure a sustaining period three times longer than the above-mentioned selective writing system having 8 sub-fields even though the number of sub-fields is enlarged into ten, so that it can realize a bright picture with 256 gray levels.

However, the selective erasing system has a disadvantage of low contrast because the full screen is turned on in the entire writing period.

In the selective erasing system, if the full screen continues to be turned on in the sustaining period of 9.57 ms within one frame consisting of 10 sub-fields SF1 to SF10 as shown in FIG. 3, then a light of about 300 cd/m$^2$ corresponding to a brightness of the peak white is produced. A brightness corresponding to the black is 15.7 cd/m$^2$, which is a brightness value of 0.7 cd/m$^2$ generated in once reset period plus 1.5 cd/m$^2$×10 sub-fields generated in the entire writing period within one frame. Accordingly, since a darkroom contrast ratio in the selective erasing system is equal to a level of 950:15.7=60:1 when one frame consists of 10 sub-fields SF1 to SF10, the selective erasing system has a low contrast. As a result, a driving method using the selective erasing system provides a bright screen owing to an assurance of sufficient sustaining period, but fails to provide a clear screen and a feeling of blurred picture due to a poor contrast.

In order to overcome a problem caused by such a poor contrast, there has been suggested a scheme of making an entire writing only once per frame and taking out the unnecessary discharge cells every sub-field SF1 to SF10. However, this scheme has a problem of poor picture quality in that next sub-field can not be driven until the previous sub-field has been turned on and thus the number of gray levels becomes merely the number of sub-fields plus one. In other words, if one frame includes 10 sub-fields, then the number of gray level become eleven as represented by the following table:

TABLE 1

| Gray level | SF1 (1) | SF2 (2) | SF3 (4) | SF4 (8) | SF5 (16) | SF6 (32) | SF7 (48) | SF8 (48) | SF9 (48) | SF10 (48) |
|---|---|---|---|---|---|---|---|---|---|---|
| 0 | x | x | x | x | x | x | x | x | x | x |
| 1 | o | x | x | x | x | x | x | x | x | x |
| 3 | o | o | x | x | x | x | x | x | x | x |
| 7 | o | o | o | x | x | x | x | x | x | x |
| 15 | o | o | o | o | x | x | x | x | x | x |
| 31 | o | o | o | o | o | x | x | x | x | x |
| 63 | o | o | o | o | o | o | x | x | x | x |
| 111 | o | o | o | o | o | o | o | x | x | x |
| 159 | o | o | o | o | o | o | o | o | x | x |
| 207 | o | o | o | o | o | o | o | o | o | x |
| 255 | o | o | o | o | o | o | o | o | o | o |

in Table 1, 'SFx' means the x-numbered sub-field and '(y)' expresses a brightness weight set for the subject sub-filed as a decimal number y. Further, 'O' represents a sate in which the subject sub-field is turned on while 'x' does not state in which the subject sub-filed is turned-off.

In this case, since only 1331 colors are expressed by all combination of refd, green and blue colors, color expression ability becomes considerably insuffiecient in comparison to true colors of 16,700,000. The PDP adopting such a system has a darkroom contrast ratio of 430:1 by a peak white of 950 cd/m$^2$ when the full screen is turned on in the display period of 9.57 ms and a black of 2.2 cd/m$^2$ which is a brightness value adding 0.7 cd/m$^2$ generated in once reset period to 1.5 cd/$^2$ generate in once entire writing period.

As described above, in the conventional PDP driving method, the selective writing system fails to make a high-speed driving because each of a data pulse for selectively turning on the discharge cells in the address period and a scanning pulse has a pulse width of 3 μs or more. The selective erasing system has an advantage of a higher speed driving than the selective writing system because each of a data pulse for selectively turning off the discharge cells and a scanning pulse is about 1 μs, whereas it has a disadvantage of a worse contrast than the selective writing system because the discharge cells in the full screen is turned on in the reset period, that is, the non-display period.

SUMMARY OF THE INVENTION

Accordingly, it is an object of the present invention to provide a method and apparatus of driving a plasma display panel that is capable of driving a plasma display panel at a higher speed as well as improving the contrast.

It is another object of the present invention to provide a method and apparatus of driving the plasma display panel that is adaptive to carrying out not only selective write but also selective erase in a predetermined period It is still another object of the present invention to provide a method and apparatus of driving the plasma display panel that is capable of increasing a driving margin upon the selective write and selective erase in the event that the selective write and the selective erase are all carried out in one frame period.

It is still another object of the present invention to provide a method and apparatus of driving the plasma display panel that is capable of making an initialization stable upon the selective erase in the event that the selective write and the selective erase are all carried out in one frame period.

In order to achieve these and other objects of the invention, a method of driving a plasma display panel that selects cells in use of selective writing sub-fields and selective erasing sub-fields arranged within one frame period and has a plurality of scanning electrodes, a plurality of sustaining electrodes and a plurality of address electrodes, according to an aspect of the present invention includes steps of selecting an on-cell by generating a writing discharge in use of a first scanning voltage in the selective writing sub-fields; and selecting an off-cell by generating an erasing discharge in use of a second scanning voltage in the selective erasing sub-fields.

Herein, the selective writing sub-field is arranged before the selective erasing sub-field.

Herein, the selective erasing sub-field is arranged between the selective writing sub-fields.

Herein, the selective writing sub-field includes a reset period for initializing the plasma display panel; a writing address period for selecting the on-cell; a sustaining period for causing a sustaining discharge for the on-cells; and a post-erasure period for eliminating electric charge generated by the sustaining discharge.

Herein, the last selective writing sub-field adjacent to the selective erasing sub-field has the post-erasure period omitted.

Herein, the selective erasing sub-field includes an erasing address period for selecting the off-cell; and a sustaining period for causing a sustaining discharge for the on-cells.

Herein, the last selective erasing sub-field adjacent to the selective writing sub-field is arranged after the sustaining period, and further includes a post-erasure period for eliminating electric charge generated by the sustaining discharge.

Herein, a gray level value is expressed by the combination of the selective writing sub-field and the selective erasing sub-field, and parts of the gray level values are expressed by at least any one of a Dithering technique and an error diffusion technique.

Herein, a swing width of the first scanning voltage is wider than a swing width of the second scanning voltage.

Herein, the first scanning voltage is higher than the second scanning voltage.

Herein, the step of selecting the on-cell includes steps of applying the first scanning voltage to the scanning electrode; and applying a first data voltage to the address electrode.

Herein, the step of selecting the off-cell includes steps of applying the second scanning voltage to the scanning electrode; and applying a second data voltage to the address electrode.

Herein, a first data pulse for applying the first data voltage and a second data pulse for apply the second data voltage are different in at least any one of a pulse width or a voltage level.

Herein, the reset period includes steps of applying a ramp signal with a rising gradient and a ramp signal with a descending gradient to the scanning electrode; and applying a first DC voltage to the sustaining electrode while the ramp signal with the descending gradient is applied to the scanning electrode.

Herein, the writing address period includes steps of applying the first scanning voltage to the scanning electrode; applying a data voltage to the address electrode; and applying a second DC voltage that is different from the first DC voltage to the sustaining electrode.

Herein, the first DC voltage is higher than the second DC voltage.

The method further includes a step of alternately applying a sustaining pulse making the discharge of the on-cells sustained to the scanning electrode and the sustaining electrode during the sustaining period.

The method further includes a step of alternately applying a sustaining pulse making the discharge of the on-cells sustained to the scanning electrode and the sustaining electrode during the sustaining period.

Herein, the first generated sustaining pulse among the sustaining pulses has its pulse width wider than the sustaining pulses generated thereafter.

Herein, the first generated sustaining pulse among the sustaining pulses has its pulse width wider than the sustaining pulses generated thereafter.

Herein, the post-erasure period includes a step of applying a ramp signal having its voltage gradually ascend to at least any one of the scanning electrode and the sustaining electrode.

Herein, after the first sustaining pulse is applied to the scanning electrode, the sustaining pulse is alternately applied to the sustaining electrode and the scanning electrode, and then a last sustaining pulse is applied to the scanning electrode.

Herein, after the first sustaining pulse is applied to the sustaining electrode, the sustaining pulse is alternately applied to the scanning electrode and the-sustaining electrode, and then a last sustaining pulse is applied to the scanning electrode.

Herein, a first scanning pulse for applying the first scanning voltage and a second scanning pulse for applying the second scanning voltage are different in at least any one of a pulse width or a voltage level.

A method of driving a plasma display panel that selects cells in use of selective writing sub-fields and selective erasing sub-fields arranged within one frame period, sustains a discharge for the selected cells in use of a sustaining pulse, and has a plurality of scanning electrodes, a plurality of sustaining electrodes and a plurality of address electrodes, according to another aspect of the present invention includes steps of setting an erasing initialization pulse with a pulse width wider than the sustaining pulse; and applying the erasing initialization pulse to the plasma display panel before the selective erasing sub-field.

Herein, the selective writing sub-field is arranged before the selective erasing sub-field.

Herein, the selective erasing sub-field is arranged between the selective writing sub-fields.

Herein, the selective writing sub-field includes a reset period for initializing the plasma display panel; a writing address period for selecting the on-cell; a sustaining period for causing a sustaining discharge for the on-cells; and a post-erasure period for eliminating electric charge generated by the sustaining discharge.

Herein, the last selective writing sub-field adjacent to the selective erasing sub-field has the post-erasure period omitted.

Herein, the selective erasing sub-field includes an erasing address period for selecting the off-cell; and a sustaining period for causing a sustaining discharge for the on-cells.

Herein, the last selective erasing sub-field adjacent to the selective writing sub-field is arranged after the sustaining period, and the method further includes a post-erasure period for eliminating electric charge generated by the sustaining discharge.

Herein, the reset period includes steps of applying a ramp signal with a rising gradient and a ramp signal with a descending gradient to the scanning electrode of the plasma display panel; and applying a first DC voltage to the sustaining electrode while the ramp signal with the descending gradient is applied to the scanning electrode.

Herein, the writing address period includes steps of applying the first scanning voltage to the scanning electrode; applying a data voltage synchronized with the first scanning voltage to the address electrode; and applying a second DC voltage that is different from the first DC voltage to the sustaining electrode.

Herein, the first DC voltage is higher than the second DC voltage.

Herein, a start sustaining pulse first generated every sub-field has its pulse width wider than the sustaining pulses generated thereafter.

A method of driving a plasma display panel that selects cells in use of selective writing sub-fields and selective erasing sub-fields arranged within one frame period, sustains a discharge for the selected cells in use of a sustaining pulse, and has a plurality of scanning electrodes, a plurality of sustaining electrodes and a plurality of address electrodes, according to still another aspect of the present invention includes steps of setting an erasing initialization pulse with a voltage higher than the sustaining pulse; and applying the erasing initialization pulse to the plasma display panel before the selective erasing sub-field.

A driving apparatus of a plasma display panel that selects cells in use of selective writing sub-fields and selective erasing sub-fields arranged within one frame period, and has a plurality of scanning electrodes, a plurality of sustaining electrodes and a plurality of address electrodes, according to still another aspect of the present invention includes a first scanning circuit for selecting an on-cell by applying a first scanning voltage to a scanning electrode to generate a writing discharge in the selective writing sub-field; and a second scanning circuit for selecting an off-cell among the on-cells by applying a second scanning voltage, which is different from the first scanning voltage, to the scanning electrode to generate an erasing discharge in the selective erasing sub-field.

A swing width of the first scanning voltage is wider than a swing width of the second scanning voltage.

The first scanning voltage is higher than the second scanning voltage.

The driving apparatus further includes a first address circuit for applying a first data voltage to the address electrode in the selective writing sub-field.

The driving apparatus further includes a second address circuit for applying a second data voltage to the address electrode in the selective erasing sub-field.

A first data pulse for applying the first data voltage and a second data pulse for apply the second data voltage are different in at least any one of a pulse width or a voltage level.

The first scanning circuit and the second scanning circuit apply a ramp signal with a rising gradient and a ramp signal with a descending gradient to the scanning electrode during a reset period of the selective writing sub-field for initializing the cells.

The driving apparatus further includes a sustaining circuit for applying a first DC voltage to a sustaining electrode while the ramp signal with the descending gradient is applied to the scanning electrode.

The sustaining circuit applies a second DC voltage, which is different from the first DC voltage, to the sustaining electrode during a writing address period of the selective writing sub-field for selecting an on-cell.

The first DC voltage is higher than the second DC voltage.

The scanning circuits and the sustaining circuit alternately apply a sustaining pulse for sustaining a discharge of the selected on-cell in the selective writing sub-field and the selective erasing sub-field, respectively.

A sustaining pulse first generated among sustaining pulses has its pulse width wider than the sustaining pulse generated thereafter.

The scanning circuits and the sustaining circuit apply a ramp signal having its voltage gradually ascend to at least any one of the scanning electrode or the sustaining electrode after applying the sustaining pulse in the selective writing sub-field.

The first and second scanning circuits generate a first scanning pulse for applying the first scanning voltage and a second scanning pulse for applying the second scanning voltage, and the first and second scanning pulses are different in at least any one of a pulse width or a voltage level.

A driving apparatus of a plasma display panel that selects cells in use of selective writing sub-fields and selective erasing sub-fields arranged within one frame period, sustains a discharge for the selected cells in use of a sustaining pulse, and has a plurality of scanning electrodes, a plurality of sustaining electrodes and a plurality of address electrodes, according to still another aspect of the present invention includes a first scanning/address circuit for selecting on-cells in use of a writing discharge in the selective writing sub-field; a second scanning/address circuit for selecting an off-cell among the on-cells in use of an erasing discharge in the selective erasing sub-field; and a sustaining circuit applying the sustaining pulse to the selected on-cells to sustain a discharge of the on-cells, and applying an erasing initialization pulse that has its pulse width wider than the sustaining pulse before the selective erasing sub-field.

The sustaining circuit generates the erasing initialization pulse with a pulse width of about 20~50 μs.

A driving apparatus of a plasma display panel that selects cells in use of selective writing sub-fields and selective erasing sub-fields arranged within one frame period, sustains a discharge for the selected cells in use of a sustaining pulse, and has a plurality of scanning electrodes, a plurality of sustaining electrodes and a plurality of address electrodes, according to still another aspect of the present invention includes a first scanning/address circuit for selecting on-cells in use of a writing discharge in the selective writing sub-field; a second scanning/address circuit for selecting an off-cell among the on-cells in use of an erasing discharge in the selective erasing sub-field; and a sustaining circuit applying the sustaining pulse to the selected on-cells to sustain a discharge of the on-cells, and applying an erasing initialization pulse that has its voltage higher than the sustaining pulse before the selective erasing sub-field.

The sustaining circuit generates the erasing initialization pulse with a voltage of about 170~185V.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
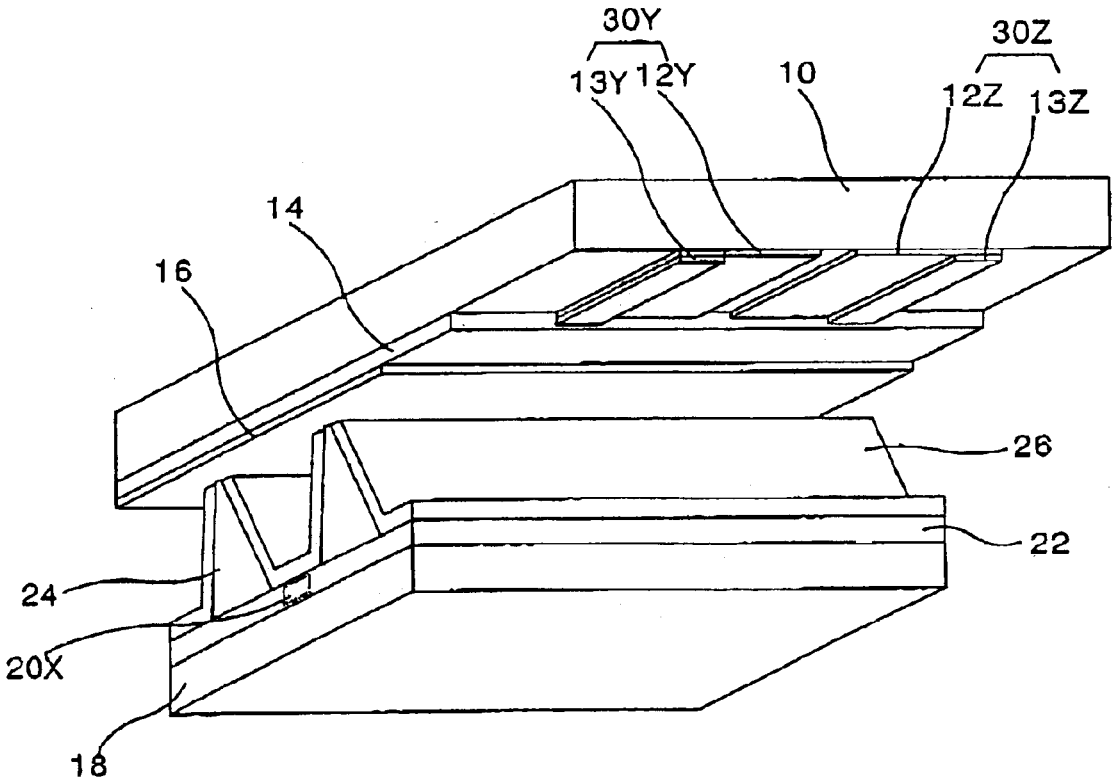
FIG. 1 RELATED ART
FIG. 1 is a perspective view showing a discharge cell structure of a conventional three-electrode AC surface-discharge plasma display panel.
Figure 2:
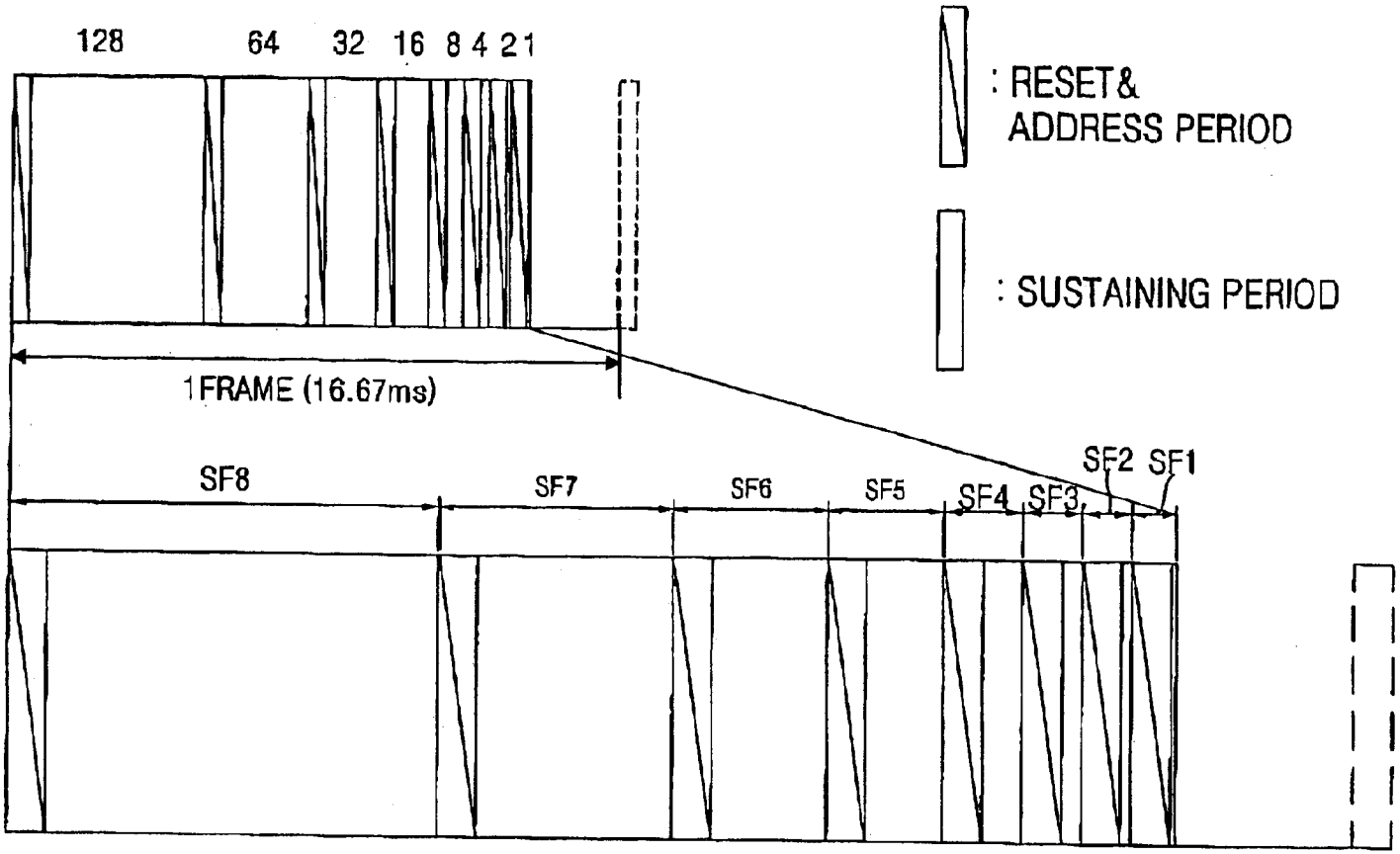
FIG.2 RELATED ART
FIG. 2 illustrates a conventional configuration of one frame including 8 sub-fields in a conventional PDP driving method.
Figure 3:
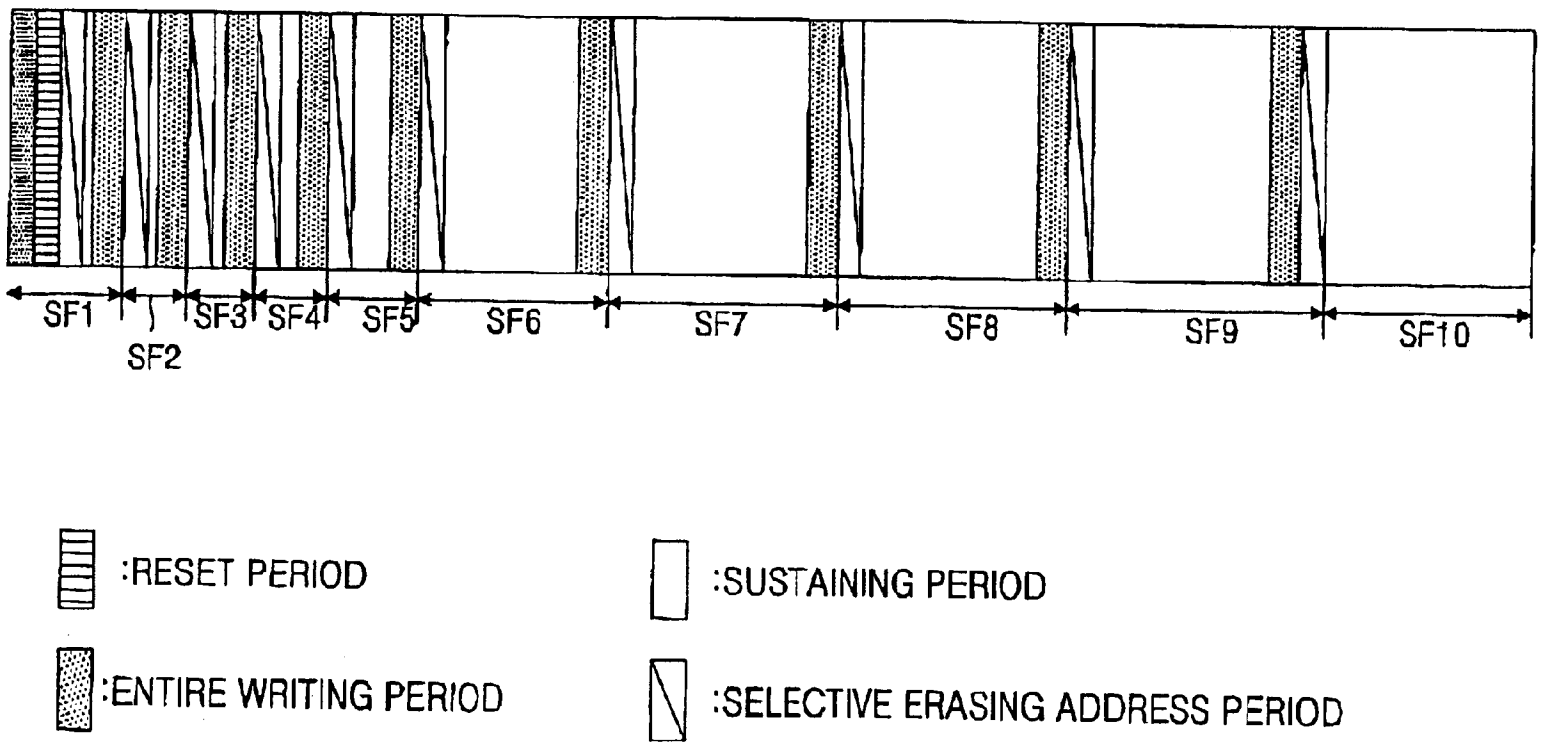
FIG. 3 RELATED ART
FIG. 3 illustrates a configuration of one frame including 10 sub-fields and preceding an entire writing discharge every sub-field in a conventional PDP driving method.
Figure 4:
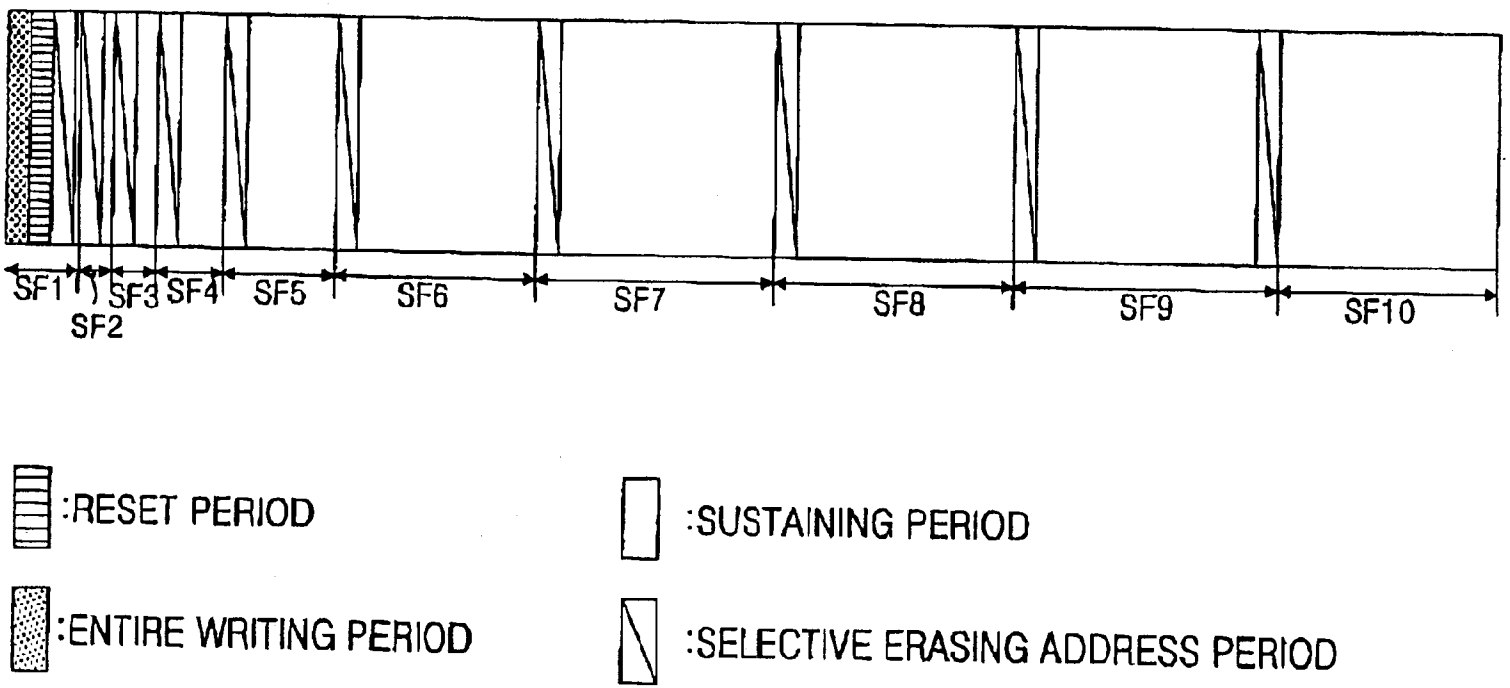
FIG. 4 RELATED ART
FIG. 4 illustrates a configuration of one frame including 10 sub-fields and once entire writing discharge in a conventional PDP driving method.
Figure 5:
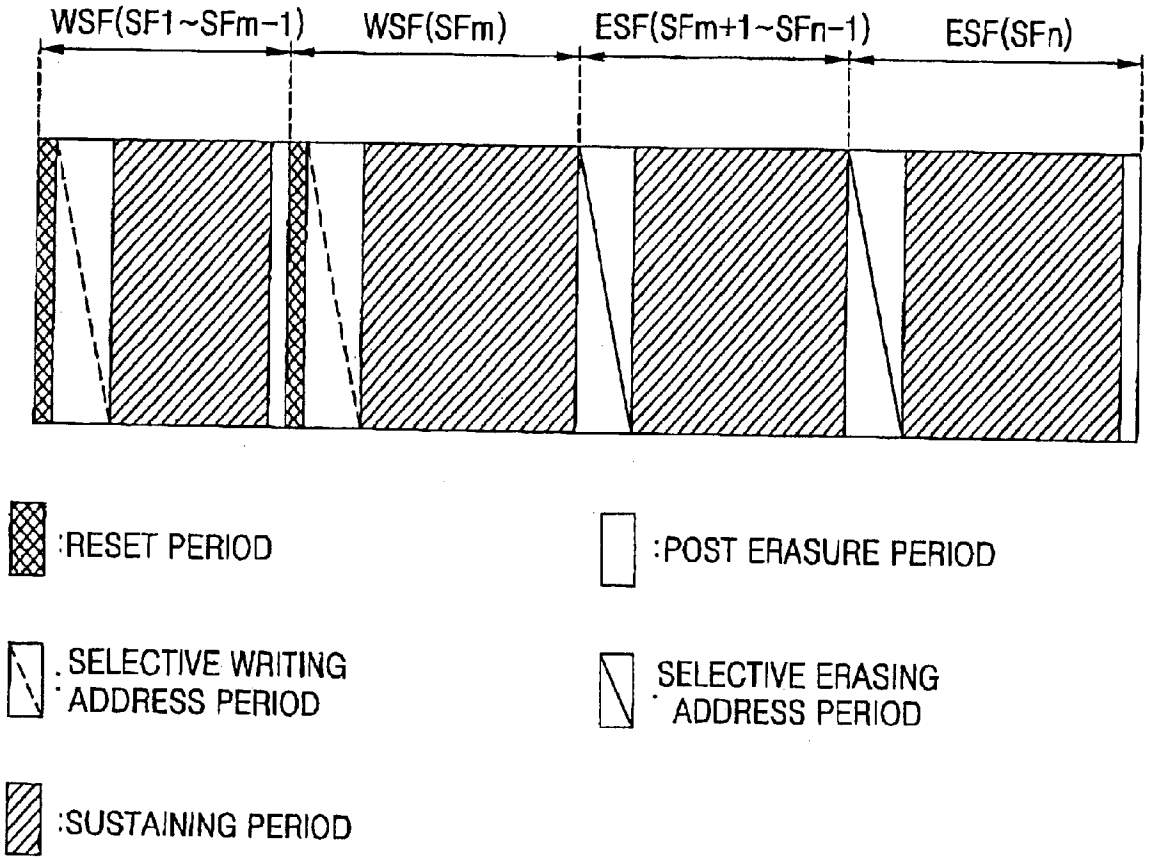
FIG. 5 illustrates a configuration of one frame in a PDP driving method according to an embodiment of the present invention.

FIG. 5 shows a configuration of one frame in a PDP driving method according to a first embodiment of the present invention. In FIG. 5, one frame includes at least more than one selective writing sub-field WSF and at least more than selective erasing sub-field ESF.

The selective writing sub-field WSF includes m (provided m is a positive integer greater than 0) pieces of sub-fields SF1 to SFm. Each of the sub-fields SF1 to SFm−1 except the $m^{th}$ sub-field SFm is divided into a reset period uniformly forming a certain amount of wall charges at cells of a full screen, a selective writing address period (hereafter, writing address period) selecting on-cells in use of a writing discharge, a sustaining period causing a sustaining discharge for the selected on-cell, and a post-erasure period erasing the wall charges in the cell after the sustaining discharge. At this, the reset period can be omitted. The $m^{th}$ sub-field SFm, the last sub-field of the selective writing sub-field WSF, is divided into a reset period, a writing address period and a sustaining period. The reset period, the writing address period and the sustaining period of the selective writing sub-field WSF are the same in each of the sub-fields SF1 to SFm, whereas, the sustaining period can be set to have a pre-determined brightness weight equal or different every sub-field.

On the other hand, it is possible to dispose a frame erasure period before the first sub-field SF1 of the selective writing sub-field WSF for applying an erasure signal to at least one among scanning electrode lines Y and sustaining electrode lines Z in order to erase all the wall charges in the cell, which were accumulated in a previous frame.

The selective erasing sub-field ESF includes n−m (provided n is a positive integer greater than m) pieces of sub-fields SFm+1 to SFn−1. Each of the $(m+1)^{th}$ to $(n-1)^{th}$ sub-fields SFm+1 to SFn−1 is divided into a selective erasing address period (hereafter, erasing address period) for selecting an Off-cell in use of an erasure discharge, and a sustaining period for generating a sustaining discharge for the on-cells. The $n^{th}$ sub-field SFn, the last sub-field of the selective erasing sub-field ESF, includes an erasing address period and a sustaining period the same as the previously arranged selective erasing sub-fields SFm+1 to SFn−1 does and further includes a post-erasure period subsequent to the sustaining period. The erasing address period is set equally and the sustaining period can be set either equally or differently in accordance with the brightness weight in the sub-fields SFm+1 to SFn of the selective erasing sub-field ESF.

The $n^{th}$ sub-field SFn, the last sub-field of the selective erasing sub-field ESF has a post-erasure period disposed at the end In the same way as the first to $(m-1)^{th}$ sub-fields SF1 to SFm−1 of the selective writing sub-field WSF. And, The $m^{th}$ sub-field SFm, the last sub-field of the selective writing sub-field WSF does not have the post-erasure period In the same way as the $(m+1)^{th}$ to $(n-1)^{th}$ sub-fields SFm+1 to SFn−1 of the selective erasing sub-field WSF.

There is a data coding method for an address explained as follows. Provided that there is one frame consisting of six selective writing sub-fields SF1 to SF6 each of which has the brightness weight set differently at '$2^0$, $2^1$, $2^2$, $2^3$, $2^4$, $2^5$', and six selective erasing sub-fields SF7 to SF12 each of which has the brightness weight set equally at '$2^5$', gray levels and coding methods expressed by combinations of sub-fields SF1 to SFn are indicated in the following table:

For instance, cells corresponding to the gray level value '11' are selected as on-cells in the first sub-field SF1, the second sub-field SF2 and the fourth sub-field SF4 having their brightness weight of $2^0$(1), $2^1$(2) and $2^3$(8) respectively by a binary code combination to be turned on, while being selected as off-cells and turned off in the remaining sub-fields.

Comparatively, cells corresponding to the gray level value '74' are selected as on-cells in the second sub-field SF2 and the fourth sub-field SF4 by a binary code combination and in the sixth sub-field SF6 and the seventh sub-field SF7 by a linear code combination to be turned on, while being selected as off-cells and turned off in the remaining sub-fields.

Each of the seventh to twelfth sub-fields SF7 to SF12 which are the selective erasing sub-field ESF selects the off-cells among the on-cells whenever it is shift to the next sub-field.

In other words, each of sub-fields SF7 to SF12, the selective erasing sub-field ESF, sequentially turns off the cells no more required among on-cells that were turned on in the previous sub-field so as to select off-cells. Due to this, the on-cells turned on, if not less than a pre-determined gray level value, should be turned on in the last sub-field of the selective writing sub-field WSF, i.e., the sixth sub-field SF6, and the previous selective erasing sub-field ESF. For instance, there is selected the off-cells turned on in the seventh sub-field SF7 among the on-cells selected in the sixth sub-field SF6, and there is selected the off-cells turned off in the eighth sub-field SF8 among on-cells remaining at the seventh sub-field SF7. Accordingly, there is no separate writing discharge needed in the sub-fields SF7 to SF12 of the selective erasing sub-field ESF in order to turn on the cells of the full screen as on-cells before the erasing address period, Further, the eighth to the twelfth sub-fields SF8 to SF12 selectively turn off the cells turned on in the previous sub-field without full screen-writing.

In this way, if one frame has the selective writing sub-field WSF and the selective erasing sub-field ESF disposed as in Table 2, the address period requires total 11.52 ms when a PDP has a VGA class resolution, that is, 480 scanning lines. On the other hand, the sustaining period requires 3.35 ms. Herein, the address period required per frame is a sum of 8.64 ms calculated by 3 μs (a pulse width of the selective writing scanning pulse)×480 lines×6(the number of selective writing sub-fields) and 2.88 ms calculated by 1 μs (a pulse width of the selective erasing scanning pulse)×480 lines×6(the number of selective erasing sub-fields). The sustaining period is a value (16.67 ms−8.64 ms−2.88 ms−0.3 ms−1 ms−1 ms) subtracting an address period of 11.52 ms, once reset period of 0.3 ms, an extra time of the vertical

TABLE 2

| Gray Level | SF1 (1) | SF2 (2) | SF3 (4) | SF4 (8) | SF5 (16) | SF6 (32) | SF7 (32) | SF8 (32) | SF9 (32) | SF10 (32) | SF11 (32) | SF12 (32) |
|---|---|---|---|---|---|---|---|---|---|---|---|---|
| 0~31 | | Binary Coding | | | | x | x | x | x | x | x | x |
| 32~63 | | Binary Coding | | | | ○ | x | x | x | x | x | x |
| 64~95 | | Binary Coding | | | | ○ | ○ | x | x | x | x | x |
| 96~127 | | Binary Coding | | | | ○ | ○ | ○ | x | x | x | x |
| 128~159 | | Binary Coding | | | | ○ | ○ | ○ | ○ | x | x | x |
| 160~191 | | Binary Coding | | | | ○ | ○ | ○ | ○ | ○ | x | x |
| 192~223 | | Binary Coding | | | | ○ | ○ | ○ | ○ | ○ | ○ | x |
| 224~255 | | Binary Coding | | | | ○ | ○ | ○ | ○ | ○ | ○ | ○ |

As can be seen from Table 2, the first to fifth sub-fields SF1 to SF5 arranged at the front side of the frame determine a brightness of a cell to express gray level values by the binary coding. On the other hand, the sixth to twelfth sub-fields SF6 to SF12 determine a brightness of a cell to express gray level values larger than a desired value by the linear coding.

synchronizing signal Vsync of 1 ms and an erasing period of 100 μs×5(the number of sub-fields)=0.5 ms from one frame period of 16.67 ms.

Accordingly, the present PDP driving method can enlarge the number of sub-fields in comparison to the conventional selective writing system to reduce a pseudo contour noise in a moving picture. Also, the present PDP driving method can more assure the sustaining period from 3.05 ms into 3.35 ms in comparison to a case where one frame includes 8 sub-fields in the conventional selective writing system.

On the other hand, the scanning pulse of the selective writing sub-field has the pulse width not limited at 3 μs, but it is possible to be selected in the range of 1~3 μs. The scanning pulse −SESCN of the selective erasing sub-field can be selected to have its pulse width of 1.5 μs or less.

When one frame has the selective writing sub-field WSF and the selective erasing sub-field ESF each disposed as in Table 2, a light of about 330 cd/$^2$ corresponding to a brightness of the peak white is produced if the full screen continues to be turned on in the sustaining period of 3.35 ms. On the other hand, if the screen is turned on only in once reset period within one frame, a light of about 0.7 cd/m$^2$ corresponding to the black is produced.

Accordingly, a darkroom contrast ratio in the present PDP driving method becomes a level of 430:1, it can be improved in comparison to a contrast ratio (i.e., 60:1) in the conventional selective erasing system including 10 sub-fields within one frame. Furthermore, a contrast in the present PDP driving method is more increased than a contrast (i.e., 430:1) in the conventional selective writing system including 8 sub-fields within one frame.

Table 3 μshows a sub-field arrangement that is more advantageous in driving at high speed than the sub-field arrangement of Table 2 and much improved in a contrast ratio.

The sub-field arrangement of Table 3 includes five selective writing sub-fields SF1 to SF5 each with their brightness weight set differently and six selective erasing sub-fields SF6 to SF11 each with their brightness weight set differently. Each of sub-fields SF6 to SF11, the selective erasing sub-field WSF, sequentially turns off the cells not required among the on-cells turned on in the previous sub-field to select the off-cells.

code combination to be turned on, while being selected as off-cells and turned off in the remaining sub-fields. Comparatively, cells corresponding to the gray level value '42' are selected as on-cells in the second sub-field SF2 and the fourth sub-field SF4 by a binary code combination and in the fifth sub-field SF5 and the sixth sub-field SF6 by a linear code combination to be turned on, while being selected as off-cells and turned off in the remaining sub-fields.

There are part of gray level values not expressed according to the sub-field arrangement of Table 3. In other words, all the gray level values of 0 to 47 can be expressed, but a gray level range of 48 to 55, 72 to 87, 104 to 127, 144 to 128 and 194 to 239 cannot be expressed by binary code combinations and linear code combinations in Table 3. The unexpressed gray level range can be corrected in similarity to gray level values to be expressed using a Dithering or an error diffusion technique. If a portion of gray level range in such high gray levels is displayed by the Dithering or the error diffusion technique, then a picture quality is slightly deteriorated, but the deterioration extent thereof can be minimized.

When a PDP has a VGA class resolution, a time required for an address period is merely 10.08 ms in the sub-field arrangement of Table 3. The sustaining period can be sufficiently assured into 4.89 ms as much as the address period is reduced. Herein, the address period is a sum of 7.2 ms calculated by 3 μs (a pulse width of the selective writing scanning pulse)×480 lines×5(the number of selective writing sub-fields) per frame and 2.88 ms calculated by 1 μs (a pulse width of the selective erasing scanning pulse)×480 lines×6(the number of selective scanning sub-fields) per frame. The sustaining period is a value (16.67 ms−10.8 ms−0.3 ms−1 ms−0.5 ms) subtracting an address period of 10.08 ms, once reset period of 0.3 ms, an extra time of the vertical synchronizing signal Vsync of 1 ms and an erasing period of 100 μs×4 (the number of sub-fields)=0.4 ms from one frame period of 16.67 ms. If the full screen is turned on in the sustaining period of 4.89 ms, a light of about 490 cd/m$^2$ corresponding to a brightness of the peak white is produced. On the other hand, it the screen is turned on only in once reset period within one frame, a light of about 0.7 cd/m$^2$ corresponding to the black is produced. Accordingly, a darkroom contrast ratio in the PDP driving method according to the second embodiment becomes a level of 700:1.

TABLE 3

| Gray level | SF1 (1) | SF2 (2) | SF3 (4) | SF4 (8) | SF5 (16) | SF6 (16) | SF7 (24) | SF8 (32) | SF9 (40) | SF10 (50) | SF11 (62) |
|---|---|---|---|---|---|---|---|---|---|---|---|
| 0~15 | | Binary Coding | | | x | x | x | x | x | x | x |
| 16~31 | | Binary Coding | | | ○ | x | x | x | x | x | x |
| 32~47 | | Binary Coding | | | ○ | ○ | x | x | x | x | x |
| 56~71 | | Binary Coding | | | ○ | ○ | ○ | x | x | x | x |
| 88~103 | | Binary Coding | | | ○ | ○ | ○ | ○ | x | x | x |
| 128~143 | | Binary Coding | | | ○ | ○ | ○ | ○ | ○ | x | x |
| 178~193 | | Binary Coding | | | ○ | ○ | ○ | ○ | ○ | ○ | x |
| 240~255 | | Binary Coding | | | ○ | ○ | ○ | ○ | ○ | ○ | ○ |

As can be seen from Table 3, the first to fourth sub-fields SF1 to SF4 arranged at the front side of the frame express gray level values in use of the binary coding. On the other hand, the fifth to eleventh sub-fields SF5 to SF11 express gray level values larger than a desired value in use of the linear coding.

Figure 6:
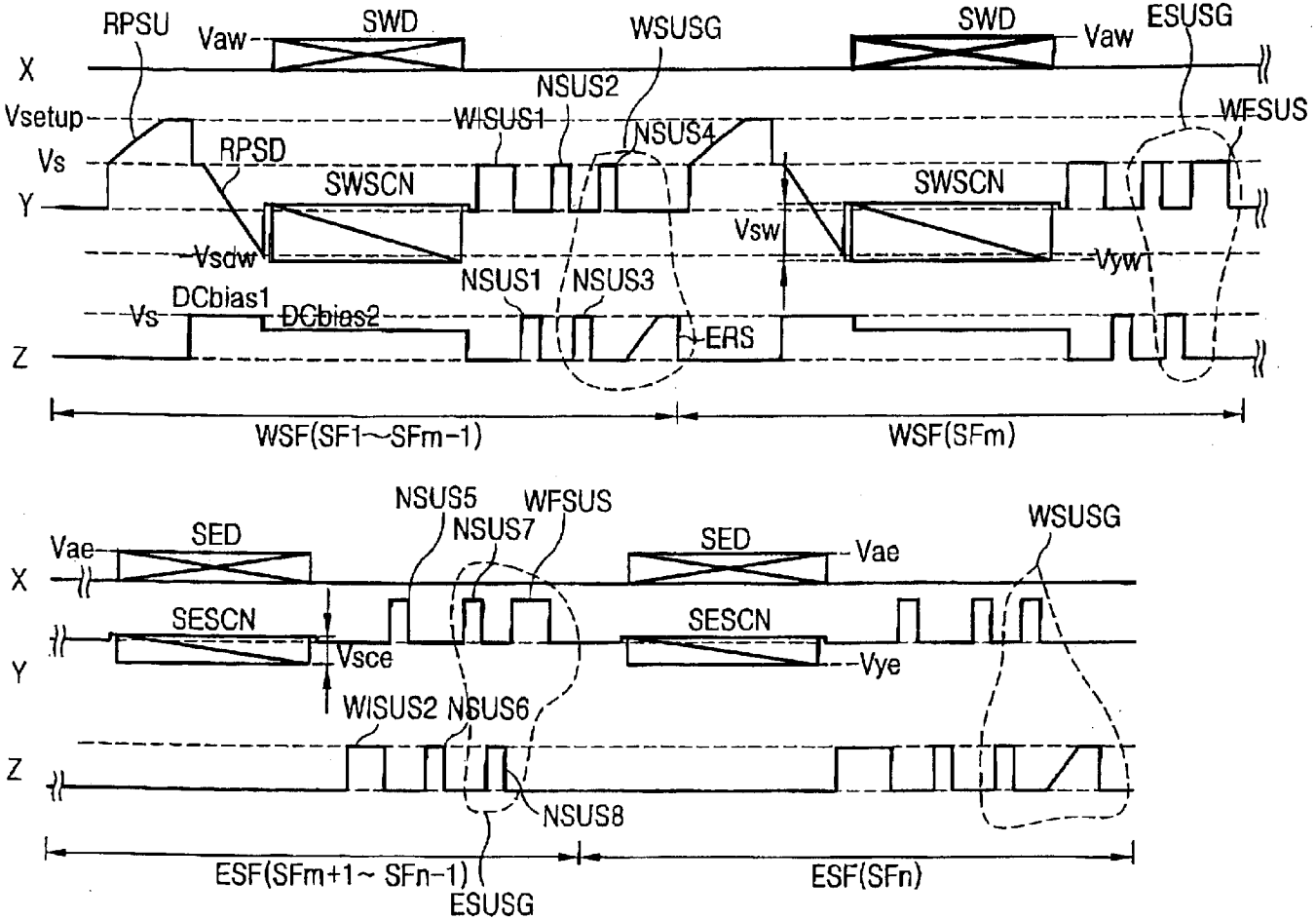
FIG. 6 is a waveform diagram of driving signals in the PDP driving method according to the embodiment of the present invention.

For instance, cells corresponding to the gray level value '11' are selected as on-cells in the first sub-field SF1, the second sub-field SF2 and the fourth sub-field SF4 having their brightness weight of 1, 2 and 8 respectively by a binary FIG. 6 depicts a driving waveform of a method of driving a PDP according to the first embodiment of the present invention.

Referring to FIG. 6, in the reset period of the selective writing sub-field WSF is ramp waveform RPSU with a rising gradient that rises up to a setup voltage Vsetup, simultaneously applied to all the scanning electrode lines Y. Herein, the setup voltage Vsetup is higher than a sustaining voltage Vs and is set within a range of about 200~240V. The sustaining voltage Vs is set within a range of about 170~185.

At the same time, there is 0V or a ground voltage GND applied to the sustaining electrode lines Z and the address electrode lines X. The rising ramp waveform RPSU generates a dark discharge, where no light is generated, between the scanning electrode lines Y and the address electrode lines X and between the scanning electrode lines Y and the sustaining electrode lines Z within the cells of the full screen.

The setup discharge makes the address electrode lines X and the sustaining electrode lines Z accumulated with positive (+) wall charges, and the scanning electrode lines Y accumulated with negative (−) wall charges. Here, the negative (−) wall charges accumulated on the scanning electrode lines Y has the same amount as the total amount of the positive (+) wall charges accumulated on the address electrode lines X and the sustaining electrode lines Z.

After the setup discharge being generated, there are a positive voltage applied to the scanning electrode lines Y and a first DC bias voltage Dcbias1 applied to the sustaining electrode lines Z at the same time The positive voltage is lower than the setup voltage, e.g., a falling ramp waveform RPSD with a descending gradient that falls down from the sustaining voltage Vs to a set-down voltage −Vsdw.

Here, the first DC bias voltage Dcbias1 is set to be the sustaining voltage Vs, and the set-down voltage −Vsdw has its absolute value lower than the scanning voltage −Vyw of the selective writing sub-field WSF and is set within a range of −40~−50V. There is a dark discharge where no light is generated, produced between the scanning electrode lines Y and the sustaining electrode lines Z by a voltage difference of the falling ramp waveform RPSD and the first DC bias voltage Dcbias1. Further, the dark discharge takes place between the scanning electrode lines Y and the address electrode lines Z in an period while the falling ramp waveform RPSD descends. The set-down discharge by the falling ramp waveform RPSD eliminates excessive wall charges that do not contribute to the address discharge among electric charges generated by the rising ramp waveform RPSU That is, the falling ramp waveform RPSD acts to set an initial condition of a stable writing address.

On the other hand, because the falling ramp waveform RPSD does not fall down to the negative scanning voltage −Vyw, but to the set-down voltage Vsdw that is higher than the negative scanning voltage −Vyw, there are enough negative wall charges left within the cells contributing to the address discharge right after the reset period as compared with the case that the falling ramp waveform RPSD falls down to the negative scanning voltage −Vyw. Just after the reset period, there still remain the negative wall charges on the scanning electrode line Y and the positive wall charges on the sustaining electrode line Z and the address electrode line X. In this way, a data voltage for generating a writing discharge during the address period is lowered by the enough wall charges left right after the reset period as compared with the case that the falling ramp waveform RPSD falls down to the negative writing scanning voltage −Vyw.

In the address period of the selective writing sub-field WSF, there are writing scanning pulses SWSCN, that fall down to the negative writing scanning voltage −Vyw, sequentially applied to the scanning electrode lines Y and writing data pulses SWD applied to the address electrode lines X to be synchronized with the write scanning pulse SWSCN. Here, the sum of the negative scanning voltage −Vyw being the lower limit voltage of the writing scanning pulse SWSCN and the absolute value of a swing width voltage Vscw are set to be greater than 0V in order to make no erroneous discharge generated in a high temperature environment of about 40° C. or more. Herein, the swing width voltage Vscw is a voltage from the negative scanning voltage −Vyw to a writing scanning reference voltage. For instance, the negative writing scanning voltage −Vyw is about −40~−70V and the absolute value of the swing width voltage Vscw is set relatively big at about 100~130V. There is a voltage Vaw of the writing data pulse SWD set approximately within a range of 45~80V when the negative scanning voltage −Vyw and the writing swing width voltage Vscw are set in this way.

The writing scanning pulse SWSCN and the writing data pulse SWD has their pulse width set at about 3 μs, but not limited to it and the pulse width can be chosen within the range of 1~3 μs A voltage difference of the writing scanning pulse −SWSCN and the writing data pulse SWD is added to the wall voltage previously accumulated within the cell so as to generate the writing discharge within the on-cell to which the writing data pulse data are applied. The writing discharge makes the positive wall charges accumulated on the scanning electrode line Y, and the negative wall charges accumulated on the sustaining electrode line Z and the address electrode line X. The wall charges formed in this way lower the voltage applied from outside for generating a sustaining discharge during the sustaining period, i.e., the sustaining voltage.

There is a second DC bias voltage Dcbias2 applied to the sustaining electrode lines Z during the address period of the selective writing sub-field SWF. Herein, the second DC bias voltage Dcbias2 is lower than the sustaining voltage Vs. the second DC bias voltage Dcbias2 makes the writing discharge for selecting the on-cell mainly generated between the address electrode line X and the scanning electrode line Y, and the negative wall charges accumulated on the sustaining electrode line Z within the on-cell upon the writing discharge, thereby having the applied voltage from the outside required for the sustaining discharge, i.e., the sustaining voltage Vs lowered further.

There is a start sustaining pulse WISUS1 applied to the scanning electrode lines Y at the beginning of the sustaining period of the selective writing sub-field SWF. Herein, the start sustaining pulse WISUS1 has a wide pulse width of about 10~50 and its voltage level the same as the sustaining voltage Vs. The pulse width of the start sustaining pulse WISUS is set wider than that of normal sustaining pulses NSUS1 to NSUS4 so that the sustaining discharge is made to be more stable by increasing the amount of the wall charges within the on-cell when the sustaining period starts than when the normal sustaining pulses NSUS1 to NSUS4 are applied at the beginning of the sustaining period Subsequently to the start sustaining pulse, normal sustaining pulses NSUS2, NSUS3 are alternately applied to the scanning electrode lines Y and the sustaining electrode lines Z after the normal sustaining pulse NSUS1 is applied to the sustaining electrode lines Z. And the last sustaining pulse is applied to the scanning electrode lines Y as a normal sustaining pulse NSUS4 in the first to the $(m-1)^{th}$ sub-fields SF1 to SFm−1 except the $m^{th}$ sub-field SFm, a preceding sub-field of the selective erasing sub-field SEF. Herein, the normal sustaining pulses NSUS1 to NSUS4 has their pulse width set within a range of about 1.5~5 μs. There is the sustaining discharge produced in the on-cells where the writing discharge was generated the writing address period whenever the sustaining pulses MISUS, MSUS1 to MSUS3 and MFSUS are applied.

On the other hand, the last sustaining pulse WFSUS of the $m^{th}$ sub-field SFm, the last sub-field of the selective writing sub-field WSF, has its pulse width set to be wider than the normal sustaining pulse NSUS4 to make an initialization of the $(m+1)^{th}$ sub-field SFm+1 of the selective erasing sub-field. To describe more particularly, if the pulse width of the sustaining pulse WSF is made to get wider, there is the sustaining discharge generated stably and the wall charges within all the on-cells do not decrease, but increase up to a certain amount to make the wall charges within all the on-cells uniform. If the wall charges of the on-cells are initialized with a uniform and enough amount, an addressing driving margin of the subsequent selective erasing sub-field SEF gets wide and an address operation is stabilized. The pulse width of the last sustaining pulse WFSUS for the initialization of the selective erasing sub-field SEF is widely set at about 20~50 μs, its voltage level is set at about the sustaining voltage Vs. On the other hand, the last sustaining pulse WFSUS has its pulse width increased, but its voltage level may, be set higher than that of the normal sustaining pulse. Or, its voltage level and pulse width may be set to be greater than those of the normal sustaining pulse.

After the last sustaining discharge being generated, there is a post erasure ramp waveform ERS applied to the sustaining electrode lines Z during the period of the first to the (m−1)th sub fields SF1 to SFm−1 except the last sub-field SFm of the selective writing sub-field WSF. The post erasure ramp waveform ERS generates a weak erasing discharge within the on-cell to eliminate the wall charges generated by the sustaining discharge. Contrary to this, after the last sustaining discharge is generated in the last sub-field SFm of the selective writing sub-field WSF, it is transferred to the first sub-field SFm+1 of the selective erasing sub-field without any erasing signal. As a result, the post erasure ramp waveform ERS or an erasing voltage (or waveform) with such an erasing function is arranged at the end of the corresponding sub-field only in case that the next sub-field is the selective writing sub-field.

There should be a discharge condition of cells the same every sub-field SF1 to SFm just before a sub-field start of each sub-field SF1 to SFm of the selective writing sub-field WSF. To this end, there is equally a writing sustaining pulse group WSUSG arranged at the very end of the first to the fifth sub-fields SF1 to SF5 and at the very end of the $n^{th}$ sub-field, the last sub-field of the selective erasing sub-field ESF. The writing sustaining pulse group WSUSG includes the last normal sustaining pulse NSUS4 applied to the scanning electrode lines Y, the last normal sustaining pulse NSUS3 applied to the sustaining electrode lines Z and a post erasure ramp waveform ERS.

In the address period of the selective erasing sub-field ESF, there is a erasing writing scanning pulse SESCN sequentially applied to the scanning electrode lines Y, and at the same time, a erasing data pulse SED applied to the address electrode lines X. Herein, the erasing writing scanning pulse SESCN falls down to a negative erasing scanning voltage −Vye and the erasing data pulse SED is synchronized with the erasing scanning pulse SESCN. Herein, the sum of the erasing scanning voltage −Vye being the lower limit voltage of the erasing scanning pulse SESCN and an erasing scanning swing width voltage Vsce being from the erasing scanning voltage −Vye to a scanning reference voltage is set at 0V or near 0V in order to prevent an erroneous discharge from being generated upon the sustaining discharge. This is for preventing the wall charge accumulated within the on-cell from being eliminated by making a difference between the voltage on the scanning electrode lines Y and the voltage on the sustaining electrode lines Z not be big. For instance, the erasing scanning voltage −Vye is set relatively small at about −20~−40V, and the absolute value of the erasing scanning swing width voltage Vsce is set relatively small at about 50~20V to be smaller than the writing scanning reference voltage Vscw. When the negative scanning voltage −Vye and the erasing scanning swing width voltage Vsce are set, the voltage of the erasing data pulse SED is set at about 30~55V.

The pulse widths of the selective erasing scanning pulse −SESCN and the erasing data SED are set to be smaller than those of the selective writing scanning pulse −SESCN and the writing data SWD. Under this condition, the pulse widths of the erasing scanning pulse −SESCN and the erasing data SED can be selected within 1.5 μs.

When a voltage difference between the selective erasing scanning pulse −SESCN and the selective erasing data pulse SWD is added to the wall voltage within the on-cell sustained from the previous sub-field, there is an erasing discharge generated within the on-cell to which the selective erasing data pulse SED is applied. This erasing discharge eliminates the wall charges within the on-cell as much as there is no discharge generated even though the sustaining voltage is applied.

There is 0V or a ground voltage GND applied to the sustaining electrode lines Z during the address period of the selective erasing sub-field SEF.

The sustaining period of the selective erasing sub-field SEF starts when a start sustaining pulse WISUS2 is applied to the sustaining electrode lines Z in order to make the sustaining discharge stably generated. Herein, the start sustaining pulse WISUS2 has its pulse width of about 20~50 μs to be wide and its voltage level set at the sustaining voltage Vs. Subsequently, after a normal sustaining pulse NSUS5 are applied to the scanning electrode lines Y, normal sustaining pulses NSUS6, NSUS7 and NSUS8 are alternately applied to the sustaining electrode lines Z and the scanning electrode lines Y. The normal sustaining pulses NSUS5 to NSUS8 has its pulse width set within 1.5~5 μs. And the last sustaining pulse WFSUS arranged in the $(m+1)^{th}$ to $(n-1)^{th}$ sub-fields SFm+1 to SFn−1 except the $n^{th}$ sub-field SFn, the last sub-field of the selective erasing sub-field, has its voltage level set at about the sustaining voltage Vs and its pulse width set to be wider than the normal sustaining pulse to be applied, in the same way as that arranged in the last sub-field SFm of the selective writing sub-field SWF. The last sustaining pulse WFSUS makes the wall charges within on-cells enough in their amount and uniform with a certain amount and then stabilizes the initialization of the next selective erasing sub-fields SFm+2 to SFn.

On the other hand, the start sustaining pulse WISUS2 of the selective erasing sub-field SEF is applied to the sustaining electrode lines Z in order to sustain the discharge of the on-cell in the event that the sustaining pulses NSUS4 WFSUS applied at the end of the previous sub-field is applied to the scanning electrode lines Y on the contrary, the start sustaining pulse WISUS of a current selective erasing sub-field SEF is applied to the scanning electrodes Y in order to sustain the discharge of the on-cell in the event that the sustaining pulse applied at the end of the previous sub-field is applied to the sustaining electrode lines Z.

The discharge condition of each cell should be made equal every sub-field SFm+1 to SFn just before the sub-field start of each sub-field SFm+1 to SFn of the selective erasing sub-field ESF. To this end, an erasing sustaining pulse group ESUSG is equally arranged both at the very end of the $(m+1)^{th}$ to the $(n-1)^{th}$ sub-field SFm+1 to SFn−1 and at the very end of the $m^{th}$ sub-field SFm, the last sub-field of the selective writing sub-field. The erasing sustaining pulse group ESUSG includes a normal sustaining pulse NSUS7 applied to the scanning electrode lines Y, and sustaining pulses NSUS8 and MFSUS sequentially applied to the sustaining electrode lines Z and the scanning electrode lines Y subsequently to the sustaining pulse NSUS7.

Figure 7:
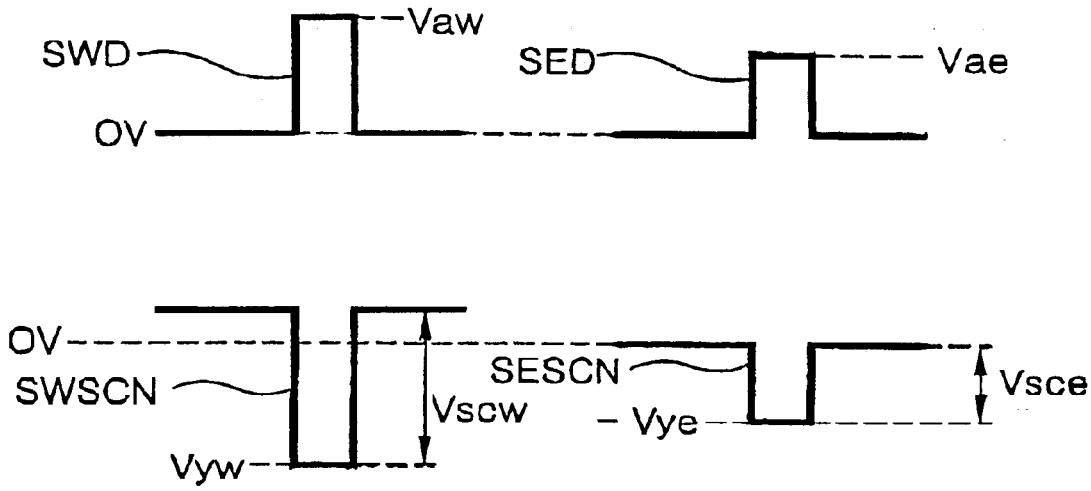
FIG. 7 is a waveform diagram particularly representing a scanning pulse and a data pulse shown in FIG. 6.

A method and apparatus of driving a plasma display panel according to the embodiment of the present invention, as in FIGS. 6 and 7, sets the data voltages Vaw and Vae and the scanning voltage −Vyw, Vscw, −Vye and Vsce differently in the selective writing sub-field SWF and in the selective erasing sub-field SEF respectively. This is for assuring a driving margin to the utmost in the selective writing sub-field SWF and the selective erasing sub-field SEF respectively, the discharge property of which are different from each other. In other words, if the uniformity is low by the fact that the size of the PDP increases or the cell decreases, the driving margin lessens as much, therefore it becomes difficult to make the driving margin big in both the selective writing sub-field SWF and the selective erasing sub-field SEF. To this end, the scanning voltages Vscw, −Vyw, Vsce, −Vye of the selective writing sub-field SWF and the selective erasing sub-field SEF are set differently as in FIG. 7. Further, the data voltages Vaw, Vae of the selective writing sub-field SWF and the selective erasing sub-field SEF may be set identically or differently. The reason why the scanning voltages Vscw, −Vyw, Vsce, −Vye become different or the scanning voltages Vscw, −Vyw, Vsce, −Vye and the data voltages Vaw, Vae are set differently in the selective writing sub-field SWF and the selective erasing sub-field SEF is that an optimal address discharge condition is to be set in response to each method and an address driving margin is to be made big in each method because the selective writing sub-field SWF and the selective erasing sub-field has different address methods from each other. Further, as described above, this is for preventing an address erroneous discharge from being generated even under a high temperature environment in the selective writing sub-field SWF, and for preventing the erroneous discharge of the sustaining discharge generated during the sustaining period subsequent to the address period in the selective erasing sub-field SEF.

On the other hand, the voltage level of the data voltage Vae of the erasing data SED may be set lower than the data voltage Vaw of the writing data SWD in case that the pulse width thereof is relatively wide, and higher than the data voltage Vaw of the writing data SWD in case that the pulse width thereof is relatively narrow.

Figure 8:
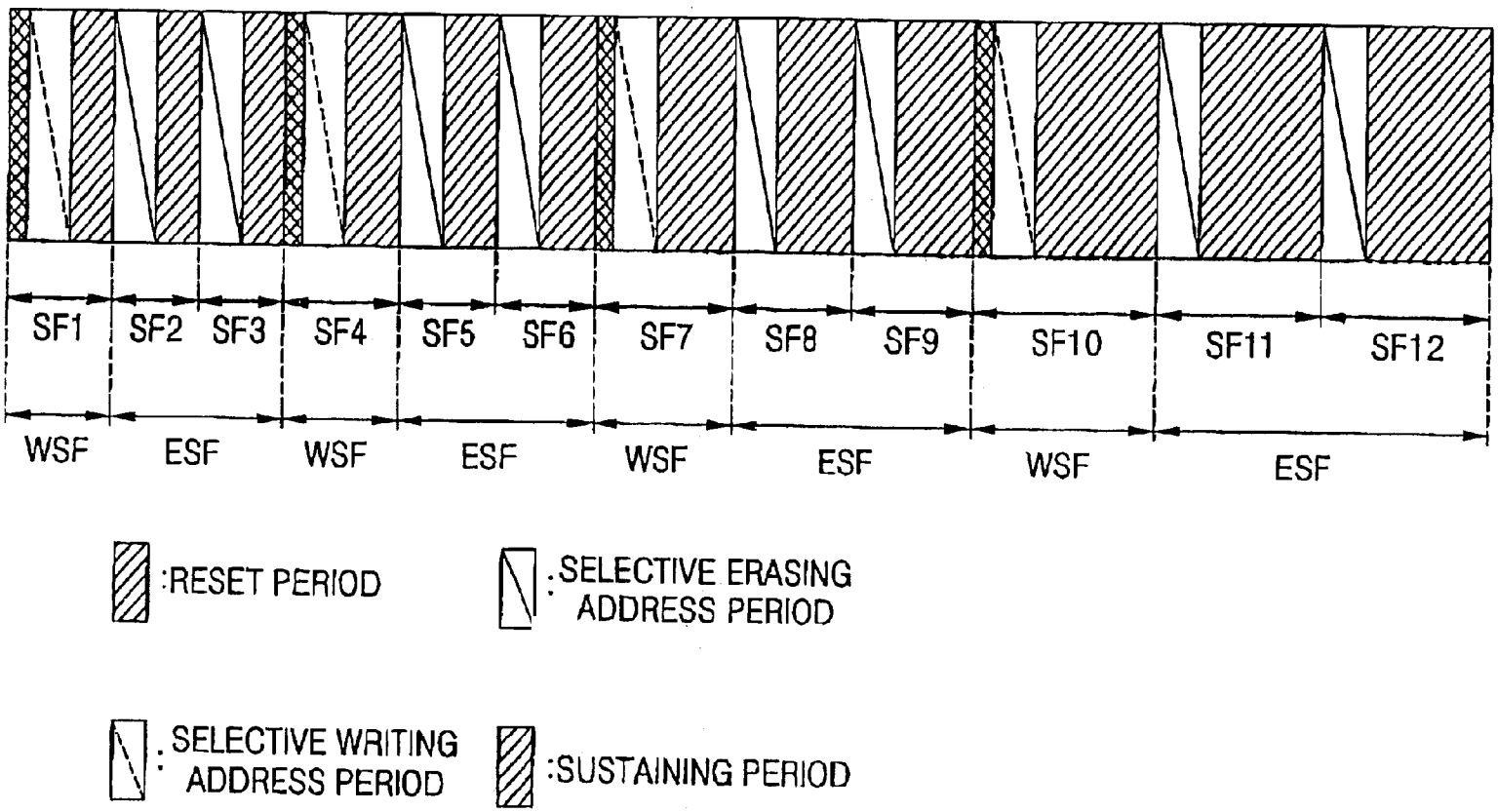
FIG. 8 illustrates a configuration of one frame in a PDP driving method according to another embodiment of the present invention.

FIG. 8 shows a configuration of one frame in a PDP driving method according to a second embodiment of the present invention.

Referring to FIG. 8, a driving method of the PDP according to the second embodiment of the present invention has the selective writing sub-fields WSF and the selective erasing sub-fields ESF alternately changed within one frame period.

The selective writing sub-fields WSF include the first sub-field SF1, the fourth sub-field SF4, the seventh sub-field SF7 and the tenth sub-field SF10. The selective erasing sub-fields ESF include the second and fourth sub-fields SF2 and SF3 arranged between the first and fourth sub-fields SF1 to SF4, the fifth and sixth sub-fields SF5 and SF6 arranged between the fourth and seventh sub-fields SF4 and SF7, the eighth and ninth sub-fields SF8 and SF9 arranged between the seventh and tenth sub-fields SF7 and SF10, and the eleventh and twelfth sub-fields SF11 and SF12 following the tenth sub-field SF10.

The number of selective erasing sub-fields ESF arranged between the selective writing sub-fields WSF may be controlled.

Each of the selective writing sub-fields WSF is divided into a reset period for initializing the full screen by accumulating a uniform amount of wall charges within the cells of the full screen, a writing address period for selecting on-cells and a sustaining period for sustaining the discharge of the on-cells in accordance with the brightness weight. These selective writing sub-fields WSF may include a separate erasing period (not shown) for erasing the sustaining discharge.

Each of the selective erasing sub-fields ESF does not have a reset period for initializing the full screen and is divided into an erasing address period for selecting off-cells among the on-cells sustained from the previous sub-field and a sustaining period for causing a sustaining discharge with respect to the on-cells where there was no erasing discharge generated during the address period.

The following Table 4-1 to 4-7 represent a gray level and coding method expressed by a driving method of a PDP according to the second embodiment of the present invention in the event that the brightness weight of the sub-fields are allotted from the first sub-field SF1 to the twelfth sub-field SF12 in the order of 20, 22, 22, 22, 24, 24, 24, 26, 26, 26.

TABLE 4-1

| Gray level | SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) |
|---|---|---|---|---|---|---|---|---|---|---|---|---|
| 0 | 0 | 0 | 0 | 0 | 0 | 0 | 0 | 0 | 0 | 0 | 0 | 0 |
| 1 | 1 | 0 | 0 | 0 | 0 | 0 | 0 | 0 | 0 | 0 | 0 | 0 |
| 2 | 1 | 1 | 0 | 0 | 0 | 0 | 0 | 0 | 0 | 0 | 0 | 0 |
| 3 | 1 | 1 | 1 | 0 | 0 | 0 | 0 | 0 | 0 | 0 | 0 | 0 |
| 4 | 0 | 0 | 0 | 1 | 0 | 0 | 0 | 0 | 0 | 0 | 0 | 0 |
| 5 | 1 | 0 | 0 | 1 | 0 | 0 | 0 | 0 | 0 | 0 | 0 | 0 |
| 6 | 1 | 1 | 0 | 1 | 0 | 0 | 0 | 0 | 0 | 0 | 0 | 0 |
| 7 | 1 | 1 | 1 | 1 | 0 | 0 | 0 | 0 | 0 | 0 | 0 | 0 |
| 8 | 0 | 0 | 0 | 1 | 1 | 0 | 0 | 0 | 0 | 0 | 0 | 0 |
| 9 | 1 | 0 | 0 | 1 | 1 | 0 | 0 | 0 | 0 | 0 | 0 | 0 |
| 10 | 1 | 1 | 0 | 1 | 1 | 0 | 0 | 0 | 0 | 0 | 0 | 0 |
| 11 | 1 | 1 | 1 | 1 | 1 | 0 | 0 | 0 | 0 | 0 | 0 | 0 |
| 12 | 0 | 0 | 0 | 1 | 1 | 1 | 0 | 0 | 0 | 0 | 0 | 0 |
| 13 | 1 | 0 | 0 | 1 | 1 | 1 | 0 | 0 | 0 | 0 | 0 | 0 |
| 14 | 1 | 1 | 0 | 1 | 1 | 1 | 0 | 0 | 0 | 0 | 0 | 0 |
| 15 | 1 | 1 | 1 | 1 | 1 | 1 | 0 | 0 | 0 | 0 | 0 | 0 |

TABLE 4-1-continued

| Gray level | SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) |
|---|---|---|---|---|---|---|---|---|---|---|---|---|
| 16 | 0 | 0 | 0 | 0 | 0 | 0 | 1 | 0 | 0 | 0 | 0 | 0 |
| 17 | 1 | 0 | 0 | 0 | 0 | 0 | 1 | 0 | 0 | 0 | 0 | 0 |
| 18 | 1 | 1 | 0 | 0 | 0 | 0 | 1 | 0 | 0 | 0 | 0 | 0 |
| 19 | 1 | 1 | 1 | 0 | 0 | 0 | 1 | 0 | 0 | 0 | 0 | 0 |
| 20 | 0 | 0 | 0 | 1 | 0 | 0 | 1 | 0 | 0 | 0 | 0 | 0 |
| 21 | 1 | 0 | 0 | 1 | 0 | 0 | 1 | 0 | 0 | 0 | 0 | 0 |
| 22 | 1 | 1 | 0 | 1 | 0 | 0 | 1 | 0 | 0 | 0 | 0 | 0 |
| 23 | 1 | 1 | 1 | 1 | 0 | 0 | 1 | 0 | 0 | 0 | 0 | 0 |
| 24 | 0 | 0 | 0 | 1 | 1 | 0 | 1 | 0 | 0 | 0 | 0 | 0 |
| 25 | 1 | 0 | 0 | 1 | 1 | 0 | 1 | 0 | 0 | 0 | 0 | 0 |
| 26 | 1 | 1 | 0 | 1 | 1 | 0 | 1 | 0 | 0 | 0 | 0 | 0 |
| 27 | 1 | 1 | 1 | 1 | 1 | 0 | 1 | 0 | 0 | 0 | 0 | 0 |
| 28 | 0 | 0 | 0 | 1 | 1 | 1 | 1 | 0 | 0 | 0 | 0 | 0 |
| 29 | 1 | 0 | 0 | 1 | 1 | 1 | 1 | 0 | 0 | 0 | 0 | 0 |
| 30 | 1 | 1 | 0 | 1 | 1 | 1 | 1 | 0 | 0 | 0 | 0 | 0 |
| 31 | 1 | 1 | 1 | 1 | 1 | 1 | 1 | 0 | 0 | 0 | 0 | 0 |
| 32 | 0 | 0 | 0 | 0 | 0 | 0 | 1 | 1 | 0 | 0 | 0 | 0 |
| 33 | 1 | 0 | 0 | 0 | 0 | 0 | 1 | 1 | 0 | 0 | 0 | 0 |
| 34 | 1 | 1 | 0 | 0 | 0 | 0 | 1 | 1 | 0 | 0 | 0 | 0 |
| 35 | 1 | 1 | 1 | 0 | 0 | 0 | 1 | 1 | 0 | 0 | 0 | 0 |
| 36 | 0 | 0 | 0 | 1 | 0 | 0 | 1 | 1 | 0 | 0 | 0 | 0 |
| 37 | 1 | 0 | 0 | 1 | 0 | 0 | 1 | 1 | 0 | 0 | 0 | 0 |

25

TABLE 4-2

| SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) | Gray level |
|---|---|---|---|---|---|---|---|---|---|---|---|---|
| 1 | 1 | 0 | 1 | 0 | 0 | 1 | 1 | 0 | 0 | 0 | 0 | 38 |
| 1 | 1 | 1 | 1 | 0 | 0 | 1 | 1 | 0 | 0 | 0 | 0 | 39 |
| 0 | 0 | 0 | 1 | 1 | 0 | 1 | 1 | 0 | 0 | 0 | 0 | 40 |
| 1 | 0 | 0 | 1 | 1 | 0 | 1 | 1 | 0 | 0 | 0 | 0 | 41 |
| 1 | 1 | 0 | 1 | 1 | 0 | 1 | 1 | 0 | 0 | 0 | 0 | 42 |
| 1 | 1 | 1 | 1 | 1 | 0 | 1 | 1 | 0 | 0 | 0 | 0 | 43 |
| 0 | 0 | 0 | 1 | 1 | 1 | 1 | 1 | 0 | 0 | 0 | 0 | 44 |
| 1 | 0 | 0 | 1 | 1 | 1 | 1 | 1 | 0 | 0 | 0 | 0 | 45 |
| 1 | 1 | 0 | 1 | 1 | 1 | 1 | 1 | 0 | 0 | 0 | 0 | 46 |
| 1 | 1 | 1 | 1 | 1 | 1 | 1 | 1 | 0 | 0 | 0 | 0 | 47 |
| 0 | 0 | 0 | 0 | 0 | 0 | 1 | 1 | 1 | 0 | 0 | 0 | 48 |
| 1 | 0 | 0 | 0 | 0 | 0 | 1 | 1 | 1 | 0 | 0 | 0 | 49 |
| 1 | 1 | 0 | 0 | 0 | 0 | 1 | 1 | 1 | 0 | 0 | 0 | 50 |
| 1 | 1 | 1 | 0 | 0 | 0 | 1 | 1 | 1 | 0 | 0 | 0 | 51 |
| 0 | 0 | 0 | 1 | 0 | 0 | 1 | 1 | 1 | 0 | 0 | 0 | 52 |
| 1 | 0 | 0 | 1 | 0 | 0 | 1 | 1 | 1 | 0 | 0 | 0 | 53 |
| 1 | 1 | 0 | 1 | 0 | 0 | 1 | 1 | 1 | 0 | 0 | 0 | 54 |
| 1 | 1 | 1 | 1 | 0 | 0 | 1 | 1 | 1 | 0 | 0 | 0 | 55 |
| 0 | 0 | 0 | 1 | 1 | 0 | 1 | 1 | 1 | 0 | 0 | 0 | 56 |
| 1 | 0 | 0 | 1 | 1 | 0 | 1 | 1 | 1 | 0 | 0 | 0 | 57 |
| 1 | 1 | 0 | 1 | 1 | 0 | 1 | 1 | 1 | 0 | 0 | 0 | 58 |
| 1 | 1 | 1 | 1 | 1 | 0 | 1 | 1 | 1 | 0 | 0 | 0 | 59 |
| 0 | 0 | 0 | 1 | 1 | 1 | 1 | 1 | 1 | 0 | 0 | 0 | 60 |
| 1 | 0 | 0 | 1 | 1 | 1 | 1 | 1 | 1 | 0 | 0 | 0 | 61 |
| 1 | 1 | 0 | 1 | 1 | 1 | 1 | 1 | 1 | 0 | 0 | 0 | 62 |
| 1 | 1 | 1 | 1 | 1 | 1 | 1 | 1 | 1 | 0 | 0 | 0 | 63 |
| 0 | 0 | 0 | 0 | 0 | 0 | 0 | 0 | 0 | 1 | 0 | 0 | 64 |
| 1 | 0 | 0 | 0 | 0 | 0 | 0 | 0 | 0 | 1 | 0 | 0 | 65 |
| 1 | 1 | 0 | 0 | 0 | 0 | 0 | 0 | 0 | 1 | 0 | 0 | 66 |
| 1 | 1 | 1 | 0 | 0 | 0 | 0 | 0 | 0 | 1 | 0 | 0 | 67 |
| 0 | 0 | 0 | 1 | 0 | 0 | 0 | 0 | 0 | 1 | 0 | 0 | 68 |
| 1 | 0 | 0 | 1 | 0 | 0 | 0 | 0 | 0 | 1 | 0 | 0 | 69 |
| 1 | 1 | 0 | 1 | 0 | 0 | 0 | 0 | 0 | 1 | 0 | 0 | 70 |
| 1 | 1 | 1 | 1 | 0 | 0 | 0 | 0 | 0 | 1 | 0 | 0 | 71 |
| 0 | 0 | 0 | 1 | 1 | 0 | 0 | 0 | 0 | 1 | 0 | 0 | 72 |
| 1 | 0 | 0 | 1 | 1 | 0 | 0 | 0 | 0 | 1 | 0 | 0 | 73 |
| 1 | 1 | 0 | 1 | 1 | 0 | 0 | 0 | 0 | 1 | 0 | 0 | 74 |
| 1 | 1 | 1 | 1 | 1 | 0 | 0 | 0 | 0 | 1 | 0 | 0 | 75 |
| 0 | 0 | 0 | 1 | 1 | 1 | 0 | 0 | 0 | 1 | 0 | 0 | 76 |

TABLE 4-3

| SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) | Gray level |
|---|---|---|---|---|---|---|---|---|---|---|---|---|
| 1 | 0 | 0 | 1 | 1 | 1 | 0 | 0 | 0 | 1 | 0 | 0 | 77 |
| 1 | 1 | 0 | 1 | 1 | 1 | 0 | 0 | 0 | 1 | 0 | 0 | 78 |
| 1 | 1 | 1 | 1 | 1 | 1 | 0 | 0 | 0 | 1 | 0 | 0 | 79 |
| 0 | 0 | 0 | 0 | 0 | 0 | 1 | 0 | 0 | 1 | 0 | 0 | 80 |
| 1 | 0 | 0 | 0 | 0 | 0 | 1 | 0 | 0 | 1 | 0 | 0 | 81 |
| 1 | 1 | 0 | 0 | 0 | 0 | 1 | 0 | 0 | 1 | 0 | 0 | 82 |
| 1 | 1 | 1 | 0 | 0 | 0 | 1 | 0 | 0 | 1 | 0 | 0 | 83 |
| 0 | 0 | 0 | 1 | 0 | 0 | 1 | 0 | 0 | 1 | 0 | 0 | 84 |
| 1 | 0 | 0 | 1 | 0 | 0 | 1 | 0 | 0 | 1 | 0 | 0 | 85 |
| 1 | 1 | 0 | 1 | 0 | 0 | 1 | 0 | 0 | 1 | 0 | 0 | 86 |
| 1 | 1 | 1 | 1 | 0 | 0 | 1 | 0 | 0 | 1 | 0 | 0 | 87 |
| 0 | 0 | 0 | 1 | 1 | 0 | 1 | 0 | 0 | 1 | 0 | 0 | 88 |
| 1 | 0 | 0 | 1 | 1 | 0 | 1 | 0 | 0 | 1 | 0 | 0 | 89 |
| 1 | 1 | 0 | 1 | 1 | 0 | 1 | 0 | 0 | 1 | 0 | 0 | 90 |
| 1 | 1 | 1 | 1 | 1 | 0 | 1 | 0 | 0 | 1 | 0 | 0 | 91 |
| 0 | 0 | 0 | 1 | 1 | 1 | 1 | 0 | 0 | 1 | 0 | 0 | 92 |
| 1 | 0 | 0 | 1 | 1 | 1 | 1 | 0 | 0 | 1 | 0 | 0 | 93 |
| 1 | 1 | 0 | 1 | 1 | 1 | 1 | 0 | 0 | 1 | 0 | 0 | 94 |
| 1 | 1 | 1 | 1 | 1 | 1 | 1 | 0 | 0 | 1 | 0 | 0 | 95 |
| 0 | 0 | 0 | 0 | 0 | 0 | 1 | 1 | 0 | 1 | 0 | 0 | 96 |
| 1 | 0 | 0 | 0 | 0 | 0 | 1 | 1 | 0 | 1 | 0 | 0 | 97 |
| 1 | 1 | 0 | 0 | 0 | 0 | 1 | 1 | 0 | 1 | 0 | 0 | 98 |
| 1 | 1 | 1 | 0 | 0 | 0 | 1 | 1 | 0 | 1 | 0 | 0 | 99 |
| 0 | 0 | 0 | 1 | 0 | 0 | 1 | 1 | 0 | 1 | 0 | 0 | 100 |
| 1 | 0 | 0 | 1 | 0 | 0 | 1 | 1 | 0 | 1 | 0 | 0 | 101 |
| 1 | 1 | 0 | 1 | 0 | 0 | 1 | 1 | 0 | 1 | 0 | 0 | 102 |
| 1 | 1 | 1 | 1 | 0 | 0 | 1 | 1 | 0 | 1 | 0 | 0 | 103 |
| 0 | 0 | 0 | 1 | 1 | 0 | 1 | 1 | 0 | 1 | 0 | 0 | 104 |
| 1 | 0 | 0 | 1 | 1 | 0 | 1 | 1 | 0 | 1 | 0 | 0 | 105 |
| 1 | 1 | 0 | 1 | 1 | 0 | 1 | 1 | 0 | 1 | 0 | 0 | 106 |
| 1 | 1 | 1 | 1 | 1 | 0 | 1 | 1 | 0 | 1 | 0 | 0 | 107 |
| 0 | 0 | 0 | 1 | 1 | 1 | 1 | 1 | 0 | 1 | 0 | 0 | 108 |
| 1 | 0 | 0 | 1 | 1 | 1 | 1 | 1 | 0 | 1 | 0 | 0 | 109 |
| 1 | 1 | 0 | 1 | 1 | 1 | 1 | 1 | 0 | 1 | 0 | 0 | 110 |
| 1 | 1 | 1 | 1 | 1 | 1 | 1 | 1 | 0 | 1 | 0 | 0 | 111 |
| 0 | 0 | 0 | 0 | 0 | 0 | 1 | 1 | 1 | 1 | 0 | 0 | 112 |
| 1 | 0 | 0 | 0 | 0 | 0 | 1 | 1 | 1 | 1 | 0 | 0 | 113 |
| 1 | 1 | 0 | 0 | 0 | 0 | 1 | 1 | 1 | 1 | 0 | 0 | 114 |
| 1 | 1 | 1 | 0 | 0 | 0 | 1 | 1 | 1 | 1 | 0 | 0 | 115 |
| 0 | 0 | 0 | 1 | 0 | 0 | 1 | 1 | 1 | 1 | 0 | 0 | 116 |
| 1 | 0 | 0 | 1 | 0 | 0 | 1 | 1 | 1 | 1 | 0 | 0 | 117 |

TABLE 4-4

| SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) | Gray level |
|---|---|---|---|---|---|---|---|---|---|---|---|---|
| 1 | 1 | 0 | 1 | 0 | 0 | 1 | 1 | 1 | 1 | 0 | 0 | 118 |
| 1 | 1 | 1 | 1 | 0 | 0 | 1 | 1 | 1 | 1 | 0 | 0 | 119 |
| 0 | 0 | 0 | 1 | 1 | 0 | 1 | 1 | 1 | 1 | 0 | 0 | 120 |
| 1 | 0 | 0 | 1 | 1 | 0 | 1 | 1 | 1 | 1 | 0 | 0 | 121 |
| 1 | 1 | 0 | 1 | 1 | 0 | 1 | 1 | 1 | 1 | 0 | 0 | 122 |
| 1 | 1 | 1 | 1 | 1 | 0 | 1 | 1 | 1 | 1 | 0 | 0 | 123 |
| 0 | 0 | 0 | 1 | 1 | 1 | 1 | 1 | 1 | 1 | 0 | 0 | 124 |
| 1 | 0 | 0 | 1 | 1 | 1 | 1 | 1 | 1 | 1 | 0 | 0 | 125 |
| 1 | 1 | 0 | 1 | 1 | 1 | 1 | 1 | 1 | 1 | 0 | 0 | 126 |
| 1 | 1 | 1 | 1 | 1 | 1 | 1 | 1 | 1 | 1 | 0 | 0 | 127 |
| 0 | 0 | 0 | 0 | 0 | 0 | 0 | 0 | 0 | 1 | 1 | 0 | 128 |
| 1 | 0 | 0 | 0 | 0 | 0 | 0 | 0 | 0 | 1 | 1 | 0 | 129 |
| 1 | 1 | 0 | 0 | 0 | 0 | 0 | 0 | 0 | 1 | 1 | 0 | 130 |
| 1 | 1 | 1 | 0 | 0 | 0 | 0 | 0 | 0 | 1 | 1 | 0 | 131 |
| 0 | 0 | 0 | 1 | 0 | 0 | 0 | 0 | 0 | 1 | 1 | 0 | 132 |
| 1 | 0 | 0 | 1 | 0 | 0 | 0 | 0 | 0 | 1 | 1 | 0 | 133 |
| 1 | 1 | 0 | 1 | 0 | 0 | 0 | 0 | 0 | 1 | 1 | 0 | 134 |
| 1 | 1 | 1 | 1 | 0 | 0 | 0 | 0 | 0 | 1 | 1 | 0 | 135 |
| 0 | 0 | 0 | 1 | 1 | 0 | 0 | 0 | 0 | 1 | 1 | 0 | 136 |
| 1 | 0 | 0 | 1 | 1 | 0 | 0 | 0 | 0 | 1 | 1 | 0 | 137 |
| 1 | 1 | 0 | 1 | 1 | 0 | 0 | 0 | 0 | 1 | 1 | 0 | 138 |
| 1 | 1 | 1 | 1 | 1 | 0 | 0 | 0 | 0 | 1 | 1 | 0 | 139 |
| 0 | 0 | 0 | 1 | 1 | 1 | 0 | 0 | 0 | 1 | 1 | 0 | 140 |
| 1 | 0 | 0 | 1 | 1 | 1 | 0 | 0 | 0 | 1 | 1 | 0 | 141 |
| 1 | 1 | 0 | 1 | 1 | 1 | 0 | 0 | 0 | 1 | 1 | 0 | 142 |
| 1 | 1 | 1 | 1 | 1 | 1 | 0 | 0 | 0 | 1 | 1 | 0 | 143 |

TABLE 4-4-continued

| SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) | Gray level |
|---|---|---|---|---|---|---|---|---|---|---|---|---|
| 0 | 0 | 0 | 0 | 0 | 0 | 1 | 0 | 0 | 1 | 1 | 0 | 144 |
| 1 | 0 | 0 | 0 | 0 | 0 | 1 | 0 | 0 | 1 | 1 | 0 | 145 |
| 1 | 1 | 0 | 0 | 0 | 0 | 1 | 0 | 0 | 1 | 1 | 0 | 146 |
| 1 | 1 | 1 | 0 | 0 | 0 | 1 | 0 | 0 | 1 | 1 | 0 | 147 |
| 0 | 0 | 0 | 1 | 0 | 0 | 1 | 0 | 0 | 1 | 1 | 0 | 148 |
| 1 | 0 | 0 | 1 | 0 | 0 | 1 | 0 | 0 | 1 | 1 | 0 | 149 |
| 1 | 1 | 0 | 1 | 0 | 0 | 1 | 0 | 0 | 1 | 1 | 0 | 150 |
| 1 | 1 | 1 | 1 | 0 | 0 | 1 | 0 | 0 | 1 | 1 | 0 | 151 |
| 0 | 0 | 0 | 1 | 1 | 0 | 1 | 0 | 0 | 1 | 1 | 0 | 152 |
| 1 | 0 | 0 | 1 | 1 | 0 | 1 | 0 | 0 | 1 | 1 | 0 | 153 |
| 1 | 1 | 0 | 1 | 1 | 0 | 1 | 0 | 0 | 1 | 1 | 0 | 154 |
| 1 | 1 | 1 | 1 | 1 | 0 | 1 | 0 | 0 | 1 | 1 | 0 | 155 |
| 0 | 0 | 0 | 1 | 1 | 1 | 1 | 0 | 0 | 1 | 1 | 0 | 156 |
| 1 | 0 | 0 | 1 | 1 | 1 | 1 | 0 | 0 | 1 | 1 | 0 | 157 |
| 1 | 1 | 0 | 1 | 1 | 1 | 1 | 0 | 0 | 1 | 1 | 0 | 158 |

TABLE 4-5

| SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) | Gray level |
|---|---|---|---|---|---|---|---|---|---|---|---|---|
| 1 | 1 | 1 | 1 | 1 | 1 | 1 | 0 | 0 | 1 | 1 | 0 | 159 |
| 0 | 0 | 0 | 0 | 0 | 0 | 1 | 1 | 0 | 1 | 1 | 0 | 160 |
| 1 | 0 | 0 | 0 | 0 | 0 | 1 | 1 | 0 | 1 | 1 | 0 | 161 |
| 1 | 1 | 0 | 0 | 0 | 0 | 1 | 1 | 0 | 1 | 1 | 0 | 162 |
| 1 | 1 | 1 | 0 | 0 | 0 | 1 | 1 | 0 | 1 | 1 | 0 | 163 |
| 0 | 0 | 0 | 1 | 0 | 0 | 1 | 1 | 0 | 1 | 1 | 0 | 164 |
| 1 | 0 | 0 | 1 | 0 | 0 | 1 | 1 | 0 | 1 | 1 | 0 | 165 |
| 1 | 1 | 0 | 1 | 0 | 0 | 1 | 1 | 0 | 1 | 1 | 0 | 166 |
| 1 | 1 | 1 | 1 | 0 | 0 | 1 | 1 | 0 | 1 | 1 | 0 | 167 |
| 0 | 0 | 0 | 1 | 1 | 0 | 1 | 1 | 0 | 1 | 1 | 0 | 168 |
| 1 | 0 | 0 | 1 | 1 | 0 | 1 | 1 | 0 | 1 | 1 | 0 | 169 |
| 1 | 1 | 0 | 1 | 1 | 0 | 1 | 1 | 0 | 1 | 1 | 0 | 170 |
| 1 | 1 | 1 | 1 | 1 | 0 | 1 | 1 | 0 | 1 | 1 | 0 | 171 |
| 0 | 0 | 0 | 1 | 1 | 1 | 1 | 1 | 0 | 1 | 1 | 0 | 172 |
| 1 | 0 | 0 | 1 | 1 | 1 | 1 | 1 | 0 | 1 | 1 | 0 | 173 |
| 1 | 1 | 0 | 1 | 1 | 1 | 1 | 1 | 0 | 1 | 1 | 0 | 174 |
| 1 | 1 | 1 | 1 | 1 | 1 | 1 | 1 | 0 | 1 | 1 | 0 | 175 |
| 0 | 0 | 0 | 0 | 0 | 0 | 1 | 1 | 1 | 1 | 1 | 0 | 176 |
| 1 | 0 | 0 | 0 | 0 | 0 | 1 | 1 | 1 | 1 | 1 | 0 | 177 |
| 1 | 1 | 0 | 0 | 0 | 0 | 1 | 1 | 1 | 1 | 1 | 0 | 178 |
| 1 | 1 | 1 | 0 | 0 | 0 | 1 | 1 | 1 | 1 | 1 | 0 | 179 |
| 0 | 0 | 0 | 1 | 0 | 0 | 1 | 1 | 1 | 1 | 1 | 0 | 180 |
| 1 | 0 | 0 | 1 | 0 | 0 | 1 | 1 | 1 | 1 | 1 | 0 | 181 |
| 1 | 1 | 0 | 1 | 0 | 0 | 1 | 1 | 1 | 1 | 1 | 0 | 182 |
| 1 | 1 | 1 | 1 | 0 | 0 | 1 | 1 | 1 | 1 | 1 | 0 | 183 |
| 0 | 0 | 0 | 1 | 1 | 0 | 1 | 1 | 1 | 1 | 1 | 0 | 184 |
| 1 | 0 | 0 | 1 | 1 | 0 | 1 | 1 | 1 | 1 | 1 | 0 | 185 |
| 1 | 1 | 0 | 1 | 1 | 0 | 1 | 1 | 1 | 1 | 1 | 0 | 186 |
| 1 | 1 | 1 | 1 | 1 | 0 | 1 | 1 | 1 | 1 | 1 | 0 | 187 |
| 0 | 0 | 0 | 1 | 1 | 1 | 1 | 1 | 1 | 1 | 1 | 0 | 188 |
| 1 | 0 | 0 | 1 | 1 | 1 | 1 | 1 | 1 | 1 | 1 | 0 | 189 |
| 1 | 1 | 0 | 1 | 1 | 1 | 1 | 1 | 1 | 1 | 1 | 0 | 190 |
| 1 | 1 | 1 | 1 | 1 | 1 | 1 | 1 | 1 | 1 | 1 | 0 | 191 |
| 0 | 0 | 0 | 0 | 0 | 0 | 0 | 0 | 0 | 1 | 1 | 1 | 192 |
| 1 | 0 | 0 | 0 | 0 | 0 | 0 | 0 | 0 | 1 | 1 | 1 | 193 |
| 1 | 1 | 0 | 0 | 0 | 0 | 0 | 0 | 0 | 1 | 1 | 1 | 194 |
| 1 | 1 | 1 | 0 | 0 | 0 | 0 | 0 | 0 | 1 | 1 | 1 | 195 |
| 0 | 0 | 0 | 1 | 0 | 0 | 0 | 0 | 0 | 1 | 1 | 1 | 196 |
| 1 | 0 | 0 | 1 | 0 | 0 | 0 | 0 | 0 | 1 | 1 | 1 | 197 |
| 1 | 1 | 0 | 1 | 0 | 0 | 0 | 0 | 0 | 1 | 1 | 1 | 198 |

TABLE 4-6

| SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) | Gray level |
|---|---|---|---|---|---|---|---|---|---|---|---|---|
| 1 | 1 | 1 | 1 | 0 | 0 | 0 | 0 | 0 | 1 | 1 | 1 | 199 |
| 0 | 0 | 0 | 1 | 1 | 0 | 0 | 0 | 0 | 1 | 1 | 1 | 200 |
| 1 | 0 | 0 | 1 | 1 | 0 | 0 | 0 | 0 | 1 | 1 | 1 | 201 |
| 1 | 1 | 0 | 1 | 1 | 0 | 0 | 0 | 0 | 1 | 1 | 1 | 202 |

TABLE 4-6-continued

| SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) | Gray level |
|---|---|---|---|---|---|---|---|---|---|---|---|---|
| 1 | 1 | 1 | 1 | 1 | 0 | 0 | 0 | 0 | 1 | 1 | 1 | 203 |
| 0 | 0 | 0 | 1 | 1 | 1 | 0 | 0 | 0 | 1 | 1 | 1 | 204 |
| 1 | 0 | 0 | 1 | 1 | 1 | 0 | 0 | 0 | 1 | 1 | 1 | 205 |
| 1 | 1 | 0 | 1 | 1 | 1 | 0 | 0 | 0 | 1 | 1 | 1 | 206 |
| 1 | 1 | 1 | 1 | 1 | 1 | 0 | 0 | 0 | 1 | 1 | 1 | 207 |
| 0 | 0 | 0 | 0 | 0 | 0 | 1 | 0 | 0 | 1 | 1 | 1 | 208 |
| 1 | 0 | 0 | 0 | 0 | 0 | 1 | 0 | 0 | 1 | 1 | 1 | 209 |
| 1 | 1 | 0 | 0 | 0 | 0 | 1 | 0 | 0 | 1 | 1 | 1 | 210 |
| 1 | 1 | 1 | 0 | 0 | 0 | 1 | 0 | 0 | 1 | 1 | 1 | 211 |
| 0 | 0 | 0 | 1 | 0 | 0 | 1 | 0 | 0 | 1 | 1 | 1 | 212 |
| 1 | 0 | 0 | 1 | 0 | 0 | 1 | 0 | 0 | 1 | 1 | 1 | 213 |
| 1 | 1 | 0 | 1 | 0 | 0 | 1 | 0 | 0 | 1 | 1 | 1 | 214 |
| 1 | 1 | 1 | 1 | 0 | 0 | 1 | 0 | 0 | 1 | 1 | 1 | 215 |
| 0 | 0 | 0 | 1 | 1 | 0 | 1 | 0 | 0 | 1 | 1 | 1 | 216 |
| 1 | 0 | 0 | 1 | 1 | 0 | 1 | 0 | 0 | 1 | 1 | 1 | 217 |
| 1 | 1 | 0 | 1 | 1 | 0 | 1 | 0 | 0 | 1 | 1 | 1 | 218 |
| 1 | 1 | 1 | 1 | 1 | 0 | 1 | 0 | 0 | 1 | 1 | 1 | 219 |
| 0 | 0 | 0 | 1 | 1 | 1 | 1 | 0 | 0 | 1 | 1 | 1 | 220 |
| 1 | 0 | 0 | 1 | 1 | 1 | 1 | 0 | 0 | 1 | 1 | 1 | 221 |
| 1 | 1 | 0 | 1 | 1 | 1 | 1 | 0 | 0 | 1 | 1 | 1 | 222 |
| 1 | 1 | 1 | 1 | 1 | 1 | 1 | 0 | 0 | 1 | 1 | 1 | 223 |
| 0 | 0 | 0 | 0 | 0 | 0 | 1 | 1 | 0 | 1 | 1 | 1 | 224 |
| 1 | 0 | 0 | 0 | 0 | 0 | 1 | 1 | 0 | 1 | 1 | 1 | 225 |
| 1 | 1 | 0 | 0 | 0 | 0 | 1 | 1 | 0 | 1 | 1 | 1 | 226 |
| 1 | 1 | 1 | 0 | 0 | 0 | 1 | 1 | 0 | 1 | 1 | 1 | 227 |
| 0 | 0 | 0 | 1 | 0 | 0 | 1 | 1 | 0 | 1 | 1 | 1 | 228 |
| 1 | 0 | 0 | 1 | 0 | 0 | 1 | 1 | 0 | 1 | 1 | 1 | 229 |
| 1 | 1 | 0 | 1 | 0 | 0 | 1 | 1 | 0 | 1 | 1 | 1 | 230 |
| 1 | 1 | 1 | 1 | 0 | 0 | 1 | 1 | 0 | 1 | 1 | 1 | 231 |
| 0 | 0 | 0 | 1 | 1 | 0 | 1 | 1 | 0 | 1 | 1 | 1 | 232 |
| 1 | 0 | 0 | 1 | 1 | 0 | 1 | 1 | 0 | 1 | 1 | 1 | 233 |
| 1 | 1 | 0 | 1 | 1 | 0 | 1 | 1 | 0 | 1 | 1 | 1 | 234 |

TABLE 4-7

| SF1 (1) | SF2 (1) | SF3 (1) | SF4 (4) | SF5 (4) | SF6 (4) | SF7 (16) | SF8 (16) | SF9 (16) | SF10 (64) | SF11 (64) | SF12 (64) | Gray level |
|---|---|---|---|---|---|---|---|---|---|---|---|---|
| 1 | 1 | 1 | 1 | 1 | 0 | 1 | 1 | 0 | 1 | 1 | 1 | 235 |
| 0 | 0 | 0 | 1 | 1 | 1 | 1 | 1 | 0 | 1 | 1 | 1 | 236 |
| 1 | 0 | 0 | 1 | 1 | 1 | 1 | 1 | 0 | 1 | 1 | 1 | 237 |
| 1 | 1 | 0 | 1 | 1 | 1 | 1 | 1 | 0 | 1 | 1 | 1 | 238 |
| 1 | 1 | 1 | 1 | 1 | 1 | 1 | 1 | 0 | 1 | 1 | 1 | 239 |
| 0 | 0 | 0 | 0 | 0 | 0 | 1 | 1 | 1 | 1 | 1 | 1 | 240 |
| 1 | 0 | 0 | 0 | 0 | 0 | 1 | 1 | 1 | 1 | 1 | 1 | 241 |
| 1 | 1 | 0 | 0 | 0 | 0 | 1 | 1 | 1 | 1 | 1 | 1 | 242 |
| 1 | 1 | 1 | 0 | 0 | 0 | 1 | 1 | 1 | 1 | 1 | 1 | 243 |
| 0 | 0 | 0 | 1 | 0 | 0 | 1 | 1 | 1 | 1 | 1 | 1 | 244 |
| 1 | 0 | 0 | 1 | 0 | 0 | 1 | 1 | 1 | 1 | 1 | 1 | 245 |
| 1 | 1 | 0 | 1 | 0 | 0 | 1 | 1 | 1 | 1 | 1 | 1 | 246 |
| 1 | 1 | 1 | 1 | 0 | 0 | 1 | 1 | 1 | 1 | 1 | 1 | 247 |
| 0 | 0 | 0 | 1 | 1 | 0 | 1 | 1 | 1 | 1 | 1 | 1 | 248 |
| 1 | 0 | 0 | 1 | 1 | 0 | 1 | 1 | 1 | 1 | 1 | 1 | 249 |
| 1 | 1 | 0 | 1 | 1 | 0 | 1 | 1 | 1 | 1 | 1 | 1 | 250 |
| 1 | 1 | 1 | 1 | 1 | 0 | 1 | 1 | 1 | 1 | 1 | 1 | 251 |
| 0 | 0 | 0 | 1 | 1 | 1 | 1 | 1 | 1 | 1 | 1 | 1 | 252 |
| 1 | 0 | 0 | 1 | 1 | 1 | 1 | 1 | 1 | 1 | 1 | 1 | 253 |
| 1 | 1 | 0 | 1 | 1 | 1 | 1 | 1 | 1 | 1 | 1 | 1 | 254 |
| 1 | 1 | 1 | 1 | 1 | 1 | 1 | 1 | 1 | 1 | 1 | 1 | 255 |

As can be seen from Table 4-1 to Table 4-7, the PDP driving method according to the third embodiment can continuously express total 256 gray level values of 0 to 255. The selective erasing sub-fields ESF express gray levels by the linear coding allowing a gray level expression only when the previous sub-field has been necessarily turned on. In other words, the off-cells selected in each of the second sub-field SF2, the third sub-field SF3, the fifth sub-field SF5, the sixth sub-field SF6, the eighth sub-field SF8, the ninth sub-field Sf9, the eleventh sub-field SF11 and the twelfth sub-field SF12 are selected from the on-cells sustaining the discharge from the previous sub-field.

Accordingly, the selective erasing sub-fields ESF do not require the reset period for initializing the full screen or a entire writing discharge.

The address period of the driving method of the PDP according to the second embodiment of the present invention is 9.6 ms so that the sustaining period may be assured as much more. Herein, the address period is a sum of 5.76 ms calculated by 3 μs (a pulse width of the selective writing scanning pulse)×480 lines×4 (the number of selective writing sub-fields) per frame and 3.84 ms calculated by 1 μs (a pulse width of the selective erasing scanning pulse)×480 lines×8 (the number of selective scanning sub-fields) per frame. Moreover, in the driving method of the PDP according to the second embodiment of the present invention, because the erasing period is omitted, the sustaining period may be assured even though a frame is composed of twelve sub-fields.

Further, the driving method of the PDP according to the second embodiment of the present invention has its contrast ratio improved as much as the entire writing period is omitted in the selective erasing sub-field ESF.

The arrangement of the sub-field, as in Table 1 to 4-7 can be changed by a frame unit. For instance, the $k^{th}$ frame (provided k is an arbitrary positive integer) and the $(k+1)^{th}$ frame have the number of sub-fields and brightness weight set differently.

The following Table 5 shows the brightness weight allotted by sub-fields in the $k^{th}$ frame and the $(k+1)^{th}$ frame. Herein, the brightness weight is expressed in decimal number.

TABLE 5

| Subfield | 1 | 2 | 3 | 4 | 5 | 6 | 7 | 8 | 9 | 10 |
|---|---|---|---|---|---|---|---|---|---|---|
| $K^{th}$ Frame | (2) | (8) | (16) | (32) | (32) | (32) | (32) | (32) | (32) | (32) |
| $(K + 1)^{th}$ Frame | (4) | (16) | (16) | (32) | (32) | (32) | (32) | (32) | (32) | (32) |

As can be seen from Table 5, the brightness weights of the first and second sub-fields SF1 and SF2 are different in the $k^{th}$ frame and the $(k+1)^{th}$ frame respectively so that the sustaining period and the sustaining discharge frequency becomes different corresponding thereto.

In the sub-field arrangement of Table 5, when the first to the fifth sub-fields are the selective writing sub-field WSF and the sixth to tenth sub-fields are the selective erasing sub-field ESF, the first to fourth sub-fields SF1 to SF4 are binary-coded. And the fifth to tenth sub-fields SF5 to SF10 are linearly coded.

Such a gray level expression utilizes a fact that an integration value of brightness values expressed in each of the $k^{th}$ frame and the (k+1)th frame can be observed by an observer. This will be described in detail in conjunction with the following Tables 6-1 and 6-2 that represents a gray level expression of 0 to 32 and 64.

TABLE 6-1

| Gray level | Frame | Subfield 1 | 2 | 3 | 4 | 5 | 6 | 7 | 8 | 9 | 10 |
|---|---|---|---|---|---|---|---|---|---|---|---|
| 0 | k | x | x | x | x | x | x | x | x | x | x |
| | k + 1 | x | x | x | x | x | x | x | x | x | x |
| 1 | k | ○ | x | x | x | x | x | x | x | x | x |
| | k + 1 | x | x | x | x | x | x | x | x | x | x |
| 2 | k | x | x | x | x | x | x | x | x | x | x |
| | k + 1 | ○ | x | x | x | x | x | x | x | x | x |

TABLE 6-1-continued

| Gray level | Frame | Subfield 1 | 2 | 3 | 4 | 5 | 6 | 7 | 8 | 9 | 10 |
|---|---|---|---|---|---|---|---|---|---|---|---|
| 3 | k | ○ | x | x | x | x | x | x | x | x | x |
| | k + 1 | ○ | x | x | x | x | x | x | x | x | x |
| 4 | k | x | ○ | x | x | x | x | x | x | x | x |
| | k + 1 | x | x | x | x | x | x | x | x | x | x |
| 5 | k | ○ | ○ | x | x | x | x | x | x | x | x |
| | k + 1 | x | x | x | x | x | x | x | x | x | x |
| 6 | k | x | ○ | x | x | x | x | x | x | x | x |
| | k + 1 | ○ | x | x | x | x | x | x | x | x | x |
| 7 | k | ○ | ○ | x | x | x | x | x | x | x | x |
| | k + 1 | ○ | x | x | x | x | x | x | x | x | x |
| 8 | k | x | x | x | x | x | x | x | x | x | x |
| | k + 1 | x | ○ | x | x | x | x | x | x | x | x |
| 9 | k | ○ | x | x | x | x | x | x | x | x | x |
| | k + 1 | x | ○ | x | x | x | x | x | x | x | x |
| 10 | k | x | x | x | x | x | x | x | x | x | x |
| | k + 1 | ○ | ○ | x | x | x | x | x | x | x | x |
| 11 | k | ○ | x | x | x | x | x | x | x | x | x |
| | k + 1 | ○ | ○ | x | x | x | x | x | x | x | x |
| 12 | k | x | ○ | x | x | x | x | x | x | x | x |
| | k + 1 | x | ○ | x | x | x | x | x | x | x | x |
| 13 | k | ○ | ○ | x | x | x | x | x | x | x | x |
| | k + 1 | x | ○ | x | x | x | x | x | x | x | x |
| 14 | k | x | ○ | x | x | x | x | x | x | x | x |
| | k + 1 | ○ | ○ | x | x | x | x | x | x | x | x |
| 15 | k | ○ | ○ | x | x | x | x | x | x | x | x |

TABLE 6-1-continued

| Gray level | Frame | Subfield 1 | 2 | 3 | 4 | 5 | 6 | 7 | 8 | 9 | 10 |
|---|---|---|---|---|---|---|---|---|---|---|---|
| | k + 1 | ○ | ○ | x | x | x | x | x | x | x | x |
| 16 | k | x | x | ○ | x | x | x | x | x | x | x |
| | k + 1 | x | x | ○ | x | x | x | x | x | x | x |
| 17 | k | ○ | x | ○ | x | x | x | x | x | x | x |
| | k + 1 | x | x | ○ | x | x | x | x | x | x | x |
| 18 | k | x | x | ○ | x | x | x | x | x | x | x |
| | k + 1 | ○ | x | ○ | x | x | x | x | x | x | x |

TABLE 6-2

| Gray level | Frame | Subfield 1 | 2 | 3 | 4 | 5 | 6 | 7 | 8 | 9 | 10 |
|---|---|---|---|---|---|---|---|---|---|---|---|
| 19 | k | ○ | x | ○ | x | x | x | x | x | x | x |
| | k + 1 | ○ | x | ○ | x | x | x | x | x | x | x |
| 20 | k | x | ○ | ○ | x | x | x | x | x | x | x |
| | k + 1 | x | x | ○ | x | x | x | x | x | x | x |
| 21 | k | ○ | ○ | ○ | x | x | x | x | x | x | x |
| | k + 1 | x | x | ○ | x | x | x | x | x | x | x |
| 22 | k | x | ○ | ○ | x | x | x | x | x | x | x |
| | k + 1 | ○ | x | ○ | x | x | x | x | x | x | x |
| 23 | k | ○ | ○ | ○ | x | x | x | x | x | x | x |
| | k + 1 | ○ | x | ○ | x | x | x | x | x | x | x |
| 24 | k | x | x | ○ | x | x | x | x | x | x | x |
| | k + 1 | x | ○ | ○ | x | x | x | x | x | x | x |

TABLE 6-2-continued

| Gray level | Frame | Subfield 1 | 2 | 3 | 4 | 5 | 6 | 7 | 8 | 9 | 10 |
|---|---|---|---|---|---|---|---|---|---|---|---|
| 25 | k | ○ | x | ○ | x | x | x | x | x | x | x |
| | k + 1 | x | ○ | ○ | x | x | x | x | x | x | x |
| 26 | k | x | x | ○ | x | x | x | x | x | x | x |
| | k + 1 | ○ | ○ | ○ | x | x | x | x | x | x | x |
| 27 | k | ○ | x | ○ | x | x | x | x | x | x | x |
| | k + 1 | ○ | ○ | ○ | x | x | x | x | x | x | x |
| 28 | k | x | ○ | ○ | x | x | x | x | x | x | x |
| | k + 1 | x | ○ | ○ | x | x | x | x | x | x | x |
| 29 | k | ○ | ○ | ○ | x | x | x | x | x | x | x |
| | k + 1 | x | ○ | ○ | x | x | x | x | x | x | x |
| 30 | k | x | ○ | ○ | x | x | x | x | x | x | x |
| | k + 1 | ○ | ○ | ○ | x | x | x | x | x | x | x |
| 31 | k | ○ | ○ | ○ | x | x | x | x | x | x | x |
| | k + 1 | ○ | ○ | ○ | x | x | x | x | x | x | x |
| 32 | k | x | x | x | ○ | x | x | x | x | x | x |
| | k + 1 | x | x | x | ○ | x | x | x | x | x | x |
| 64 | k | x | x | x | ○ | ○ | x | x | x | x | x |
| | k + 1 | x | x | x | ○ | ○ | x | x | x | x | x |

As seen from Table 6-1, a cell for expressing a gray level value of '1' is selected as the on-cell only in the first sub-field SF1 of the $k^{th}$ frame and selected as off-cell in the remaining whole sub-fields of the $k^{th}$ frame and the $(k+1)^{th}$ frame. At this time, an observer can observe an image at a brightness having a weighting value of '2' in a sum period of the $k^{th}$ frame and the $(k+1)^{th}$ frame. As a result, an observer observes an image at a brightness corresponding to a gray level value of '1' by the integration effect. Similarly, a gray level value '16' is selected as the on-cell only in the third sub-fields SF3 of the $k^{th}$ frame and the $(k+1)^{th}$ frame, and selected as the off-cell in the remaining sub-fields. A cell corresponding to a gray level value '33' as not indicated in Table 6-1 and Table 6-2 is selected as the on-cell in the first sub-field SF1 of the $k^{th}$ frame which has a brightness weight of '2' and in the $k^{th}$ frame which has a brightness weight of '32', and only the fourth sub-fields SF4 of the $(k+1)^{th}$ frame is turned on, whereas it is selected as the off-cell in the remaining sub-fields.

As a result, the PDP driving method according to the third embodiment of the present invention is capable of expressing 256 gray levels successively by utilizing the integration effect of two frames even when the address period is more reduced. Also, it is capable of display a natural image even when the number of sub-fields is more reduced. More specifically, the prior art requires at least four sub-fields for an expression of total 16 gray levels from 0 until 15. Comparatively, the PDP driving method according to the third embodiment can express total 16 gray levels from 0 until 15 only with two sub-fields by giving a different brightness weight to two frames and utilizing the integration effect of these two sub-fields.

A driving time and a contrast in the PDP driving method according to the third embodiment are as follows.

When a PDP has a VGA class resolution, a time required for an address period is merely 8.64 ms. As the address period is more reduced, the sustaining period can be sufficiently assured into 6.43 ms. Herein, the address period is a sum of 5.76 ms calculated by 3 μs (a pulse width of the selective writing scanning pulse)×480 lines×4(the number of selective writing sub-fields) per frame and 2.88 ms calculated by 1 μs (a pulse width of the selective erasing scanning pulse)×480 lines×6(the number of selective scanning sub-fields) per frame. The sustaining period is a value (16.67 ms−8.64 ms−0.3 ms−1 ms−0.3 ms) subtracting an address period of 8.64 ms, once reset period of 0.3 ms, an extra time of the vertical synchronizing signal Vsync of 1 ms and an erasing period of 100 μs×3(the number of sub-fields)=0.3 ms from one frame period of 16.67 ms.

If the full screen is turned on in the sustaining period of 6.43 ms, a light of about 640 cd/$m^2$ corresponding to a brightness of the peak white is produced. On the other hand, if a screen is turned on only in once reset period within one frame, a light of about 0.7 cd/$m^2$ corresponding to the black is produced. Accordingly, a darkroom contrast ratio in the PDP driving method according to the third embodiment becomes a level of 910:1.

FIGS. 9 to 12 represents a driving apparatus of a PDP according to the present invention. There is explained as follows in conjunction with FIGS. 6 and 7 showing the driving waveform according to the first embodiment of the present invention.

Figure 9:
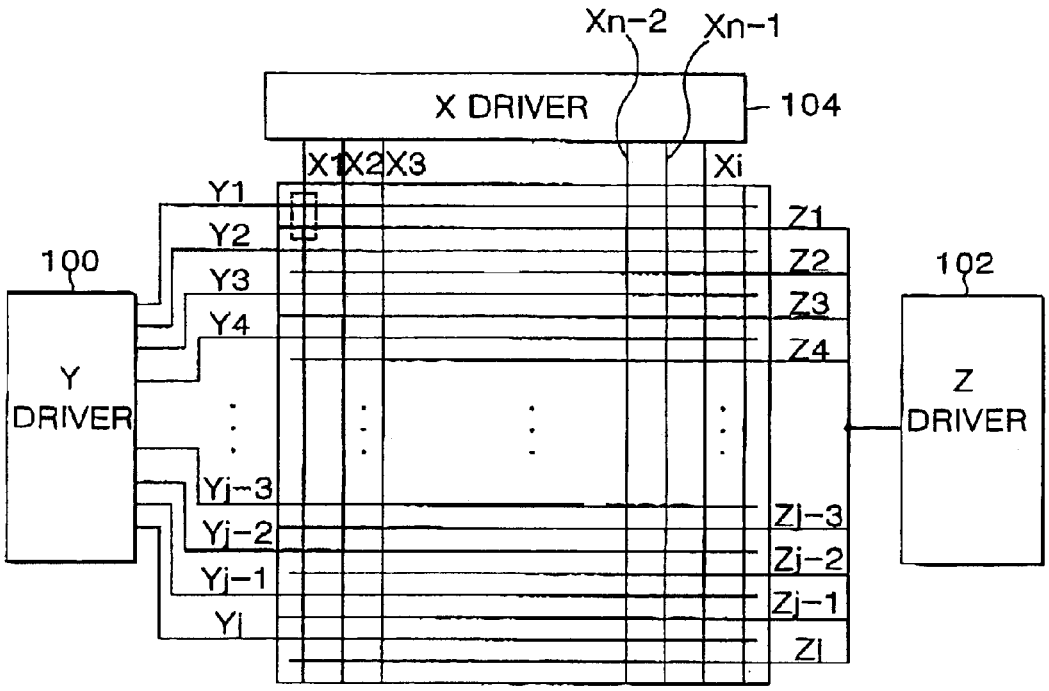
FIG. 9 is a schematic block diagram showing a configuration of a PDP driving apparatus according to an embodiment of the present invention.

Referring to FIG. 9, the driving apparatus of the PDP according to the present invention includes a Y driver 100 for driving j (provided j is an arbitrary positive integer) scanning electrode lines Y1 to Yj, a Z driver 102 for driving j sustaining electrode lines Z1 to Zj, and a X driver 104 for driving i (provided i is a positive integer less than j) address electrode lines X1 to Xi.

The Y driver 100 continuously applies setup waveform RPSU and set-down waveform RPSD to the scanning electrode lines Y1 to Yj during the reset period of the selective writing sub-field WSF to initialize the full screen, and at the same time, sequentially applies different scanning pulses SWSCN and SESCN to the scanning electrode lines Y1 to Yj during the address period of the selective writing sub-field WSF and the selective erasing sub-field SEF, Also, the Y driver 100 applies sustaining pulses WISUS1, NSUS2, NSUS4, NSUS5, NSUS7 and WFSUS in the selective writing sub-field WSF and the selective erasing sub-field ESF to cause a sustaining discharge.

The Z driver 102 is commonly connected to the sustaining electrode lines Z1 to Zj. The Z driver 102 continuously applies the first DC bias voltage Dcbias1 and the second DC bias voltage Dcbias2 to the sustaining electrode lines Z1 to Zj during the reset period and the address period of the selective writing sub-field WSF and sustains the voltage on the sustaining electrode lines Z1 to Zj at 0V or a ground voltage GND during the reset period and the address period of the selective erasing sub-field ESF. And the Z driver 102 applies sustaining pulses WISUS2, NSUS1, NSUS3, NSUS6 and NSUS8 in the selective writing sub-field WSF and the selective erasing sub-field ESF to cause a sustaining discharge.

The X driver 104 applies the writing data pulse SWD or the erasing data pulse SED to the address electrode lines X1 to Xi during the reset period and the address period of the selective writing sub-field WSF to be synchronized with the scanning pulse SWSCN and SESCN.

Figure 10:
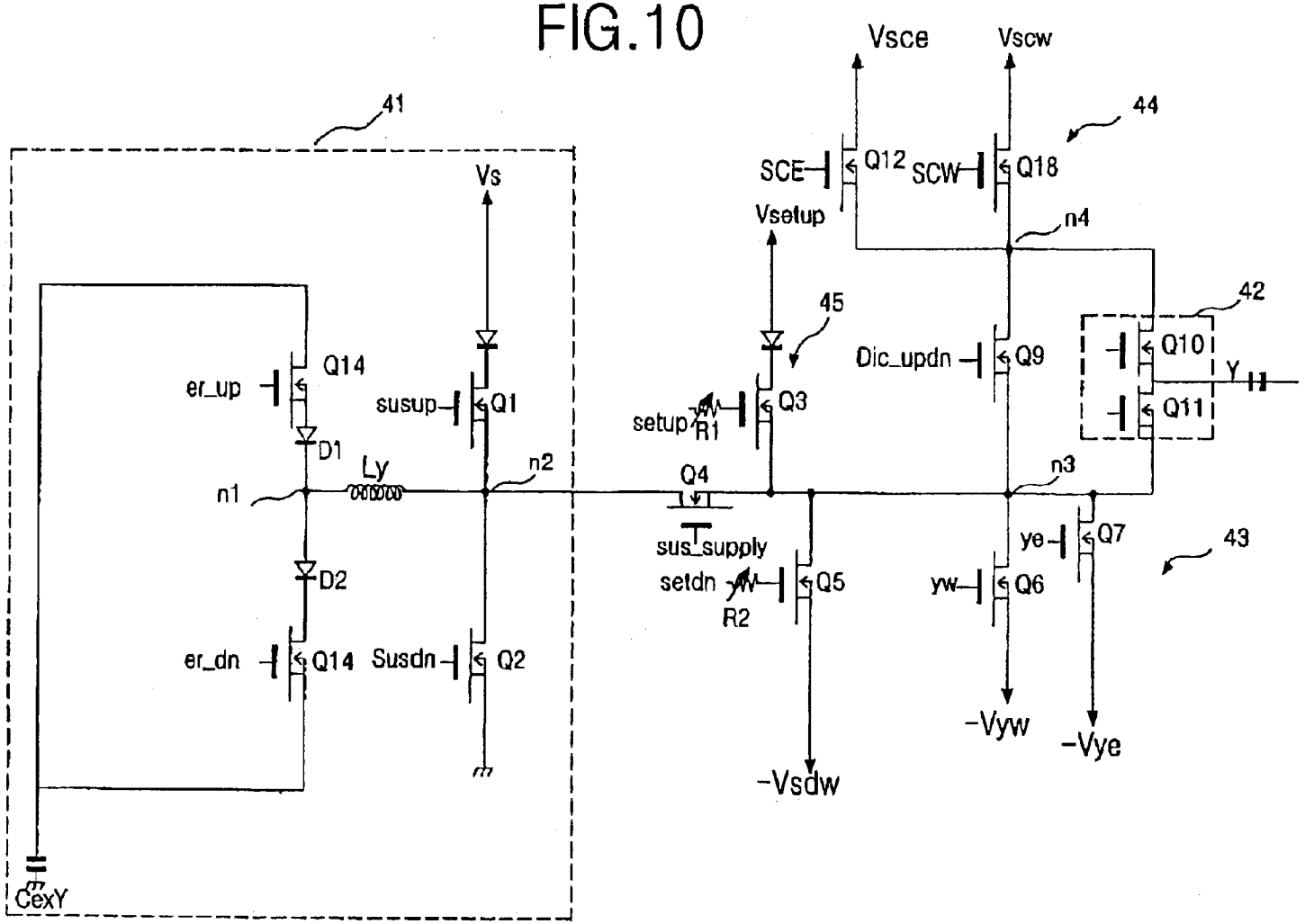
FIG. 10 is a detailed circuit diagram of the Y driver shown in FIG. 9.

FIG. 10 shows a detailed circuit diagram of the Y driver 100 for the purpose of explaining a configuration and an operation of the Y driver 100.

Referring to FIG. 10, the Y driver 100 includes a fourth switch Q4 connected between an energy recovery circuit 41 and a driver integrated circuit IC 42, a negative scanning voltage supplier 43 and a scanning reference voltage supplier 44 connected between the fourth switch Q4 and the driver IC 42 to produce the scanning pulses SWSCN and SESCN, and a setup supplier 45 and a set-down supplier 46 connected among the fourth switch Q4, the negative scanning voltage supplier 43 and the scanning reference voltage supplier 44 to generate the setup waveform RPSU and the set-down waveform RPSD.

The driver IC 42 is connected in a push-pull type and consists of tenth and eleventh switches Q10 and Q11 to which voltage signals are inputted from the energy recovery circuit 41, the negative scanning voltage supplier 43 and the scanning reference voltage supplier 44. An output line between the tenth and eleventh switches Q10 and Q11 is connected to any one of the scanning electrode lines Y1 to Yj.

The energy recovery circuit 41 includes an external capacitor CexY for charging a voltage recovered from the scanning electrode lines Y1 to Yj, switches Q14 and Q15 connected, in parallel, to the external capacitor CexY, an inductor Ly connected between a first node n1 and a second node n2, a first switch Q1 connected between a sustaining voltage source Vs and a second node n2, and a second switch Q2 connected between the second node n2 and a ground voltage terminal GND.

An operation of the energy recovery circuit will be described below It is assumed that a voltage of Vs/2 has been charged in the external capacitor CexY. If a fourteenth switch Q14 is turned on, then a voltage charged in the external capacitor CexY is applied, via the fourteenth switch Q14, a first diode D1 and the inductor Ly, to the driver IC 42 and is applied, via an internal diode (not shown) of the driver IC 42 to the scanning electrode lines Y1 to Yj. At this time, the inductor Ly constitutes a serial LC resonance circuit along with a capacitance C of the cell of the PDP to thereby apply a resonant waveform to the scanning electrode lines Y1 to Yj.

The first switch Q1 is turned on at a resonance point of the resonant waveform. If the first switch Q1 is turned on, the sustaining voltage Vs is applied to the scanning electrode lines Y1 to Yj via the first switch Q1 and the driver IC 42. After a desired time, the first switch Q1 is turned off and a fifteenth switch Q15 is turned on. At this time, reactive power not contributing to the discharge, i.e., energy, is applied to the external capacitor CexY via the scanning electrode lines Y1 to Yj, the driver IC 42, the fourth switch Q4, the second diode D2, the fifteenth switch Q15. In other words, the energy is recovered from the PDP into the external capacitor CexY. Subsequently, when the fifteenth switch Q15 is turned off and the second switch Q2 is turned on, the voltages of the scanning electrode lines Y1 to Yj remain at 0V or a ground voltage GND.

When the voltages of the scanning electrode lines Y1 to Yj are being charged or discharged by the operation of the energy recovery circuit 41, the switch Q4 is kept at an on-state so as to provide a current path between the energy recovery circuit 41 and the driver IC 42. As mentioned above, the energy recovery circuit 41 recovers the energy from the PDP and then applies the sustaining voltage Vs to scanning electrode lines Y1 to Yj using the recovered energy, thereby reducing excessive power consumption upon the discharge in the setup period and the sustaining period.

The negative scanning voltage supplier 43 consists of a sixth switch Q6 connected between a third node n3 and a writing scanning voltage source −Vyw, and a seventh switch Q7 connected between the third node n3 and a erasing scanning voltage source −Vye. The sixth switch Q6 is switched in response to a control signal yw applied from a timing controller (not shown) during the address period of the selective writing sub-field WSF to apply the writing scanning voltage −Vyw to the driver IC 42. The seventh switch Q7 is switched in response to a control signal ye applied from the timing controller (not shown) during the address period of the selective erasing sub-field ESF to apply the erasing scanning voltage −Vye to the driver IC 42.

The scanning reference voltage supplier 44 consists of a eighth switch Q8 connected between a writing scanning reference voltage source Vscw and a fourth node n4, and a twelfth switch connected between a erasing scanning reference voltage source Vsce and the fourth node n4. The eighth switch Q8 is switched in response to a control signal SCW applied from the timing controller (not shown) during the address period of the selective writing sub-field WSF to apply a writing scanning reference voltage Vscw to the driver IC 42. The twelfth switch Q12 is switched in response to a control signal SCE applied from the timing controller (not shown) during the address period of the selective erasing sub-field ESF to apply a erasing scanning reference voltage Vsce to the driver IC 42.

On the other hand, the scanning reference voltage can be equally set in the selective writing sub-field WSF and the selective erasing sub-field ESF. In this case, any one between the writing scanning voltage sources Vscw and Vsce and any one between the switches Q8 and Q12 can be eliminated.

The setup supplier 45 consists of a fourth diode D4 and a third switch Q3 connected between a setup voltage source Vsetup and the node n3. The fourth diode D4 plays a role to shut off a backward current flowing from the node n3 into the setup voltage source Vsetup. The third switch Q3 is switched in response to a control signal (setup) applied from the timing controller (not shown) during the reset period of the selective writing sub-field WSF to apply a setup waveform RPSU to the third node n3. Herein, the setup waveform RPSU has its gradient determined by a time constant value R1C. The setup waveform RPSU generated at this time is applied to the scanning electrode lines Y1 to Yj via the driver IC 42 to increase the voltage on the scanning electrode line Y up to the setup voltage Vsetup.

The set-down supplier 46 includes a fifth switch Q5 connected between the node n3 and a set-down voltage source −Vsdw. The fifth switch Q5 is switched in response to a control signal (setdn) applied from the timing controller (not shown) after a ramp waveform RPSU with a rising gradient is applied to the scanning electrode lines Y1 to Yi by the setup supplier 45, to apply a set-down waveform RPSD to the third node n3. Herein, the set-down waveform RPSD has its gradient determined by a time constant value R2C. The set-down waveform RPSD generated at this time is applied to the scanning electrode line Y via the driver IC 42 to decrease the voltage on the scanning electrode line Y down to the set-down voltage −Vsdw.

The Y driver 100 includes a ninth switch Q9 connected between the node n3 and a node n4. The switch Q9 plays a role to switch the scanning reference voltages Vscw and Vsce applied to the driver IC 42 in response to a control signal Dic_updn from the timing controller (not shown).

Figure 11:
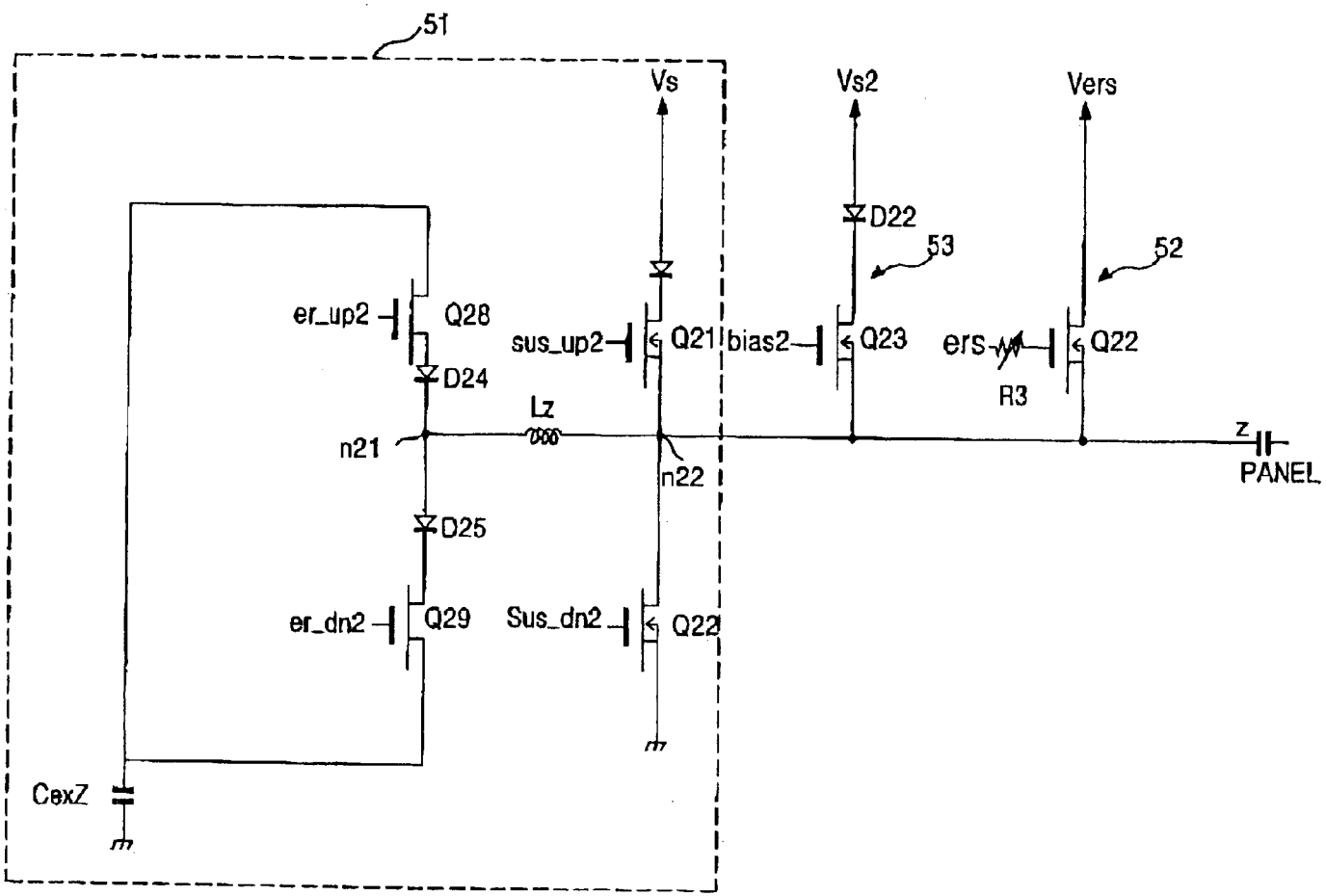
FIG. 11 is a detailed circuit diagram of the Z driver shown in FIG. 10.

FIG. 11 is a detailed circuit diagram of the Z driver 102.

Referring to FIG. 11, the Z driver 102 includes a DC bias voltage supplier 53 and a post-erasure signal supplier 52 connected between the energy recovery circuit 51 and the sustaining electrode lines Z1 to Zj.

The energy recovery circuit 51 charges the sustaining electrode lines Z1 to zj with the voltage in use of LC resonance and the charged voltage of the external capacitor CexZ and charges the external capacitor CexZ by recovering the energy from the sustaining electrode lines Z1 to Zj in the same way as that 41 of the Y driver 100. The energy recovery circuit 51 includes an external capacitor CexZ for being charged with the energy recovered from the sustaining electrode lines Z1 to Zj, switches Q28 and Q39 connected in series to the external capacitor Cexz, an inductor Lz connected between a first node n21 and a second node n22, a first switch Q21 connected between the sustaining voltage source Vs and the second node n22, and a second switch Q22 connected between the second node n22 and a ground voltage terminal GND. Reference numerals 'D23', 'D24' and 'D25' represent diodes for shutting off the backward current. Such an energy recovery circuit is driven when the sustaining voltage Vs, the DC bias voltage Vzsc and the ramp voltage Vramp.

In the energy recovery circuit 51, the first switch Q21 is switched in response to a control signal (sus-up2) from the timing controller (not shown) to sustain the voltage on the sustaining electrode lines Z1 to Zi at the sustaining voltage Vs, after an LC resonance voltage is applied to the sustaining electrode lines Z1 to Zj. Further, the first switch Q21 act to sustain the voltage on the sustaining electrode lines Z1 to Zj at the first DC bias voltage Dcbias1 while the set-down pulse is applied to the scanning electrode lines Y1 to Yj. The function and configuration of each of the devices composing the energy recovery circuit 51 except the first switch Q1 is practically the same, therefore the detailed description on this will be omitted.

DC bias voltage supplier 53 includes a diode D22 and a third switch Q23 connected between the second sustaining voltage source Vs2 and the second node n22. The third switch Q3 is switched in response to a control signal (bias2) from the timing controller (not shown) during the erasing address period of the selective erasing sub-field SEF to apply a DC voltage Vs2 that is lower than the sustaining voltage to the sustaining electrode lines Z1 to Zj.

The post-erasure signal supplier 52 includes the second switch Q22 connected between an erasing voltage source Vers and the second node n22. The second switch Q22 is switched in reponse to a control signal (ers) from the timing controller (not shown) during the post-erasure period of the selective writing sub-field WSF to apply a post-erasure signal ERS to the sustaining electrode line Z1 to Zj. Herein, the post-erasure signal ERS has its gradient determined by a time constant value R3C.

The pulse width of the sustaining pulses WSUS1, WSUS2, NSUS1 to NSUS8 and WFSUS is controlled by means of on-time of the switches Q1, Q4 and Q21 in the Y driver 100 and the Z driver 102.

Figure 12:
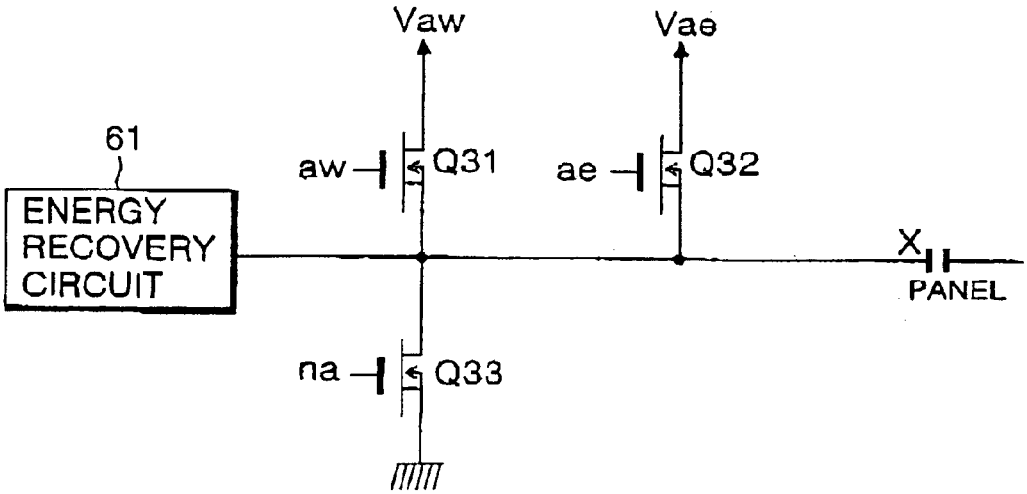
FIG. 12 is a detailed circuit diagram of the X driver shown in FIG. 11.

FIG. 12 is a circuit diagram of an X driver 104 in detail.

Referring to FIG. 12, the X driver 104 includes an energy recovery circuit 61, a first switch Q31 connected between a writing data voltage source Vaw and the address electrode lines X1 to Xi, a second switch Q31 connected between an erasing data voltage source Vae and the address electrode line X1 to Xi, and a third switch Q33 connected between the address electrode lines X1 to Xi and a ground voltage source GND.

The energy recovery circuit 61 recovers energy from the address electrode lines X1 to Xi into an external capacitor (not shown), thereby reducing the power consumption of data voltage. The configuration of the energy recovery circuit 61 is practically the same as those 41 and 51 shown in FIGS. 10 and 11.

The first switch Q31 is switched in response to a control signal (aw) from a timing controller (not shown) during the writing address period of the selective writing sub-field WSF, to apply the writing data voltage Vaw to the address electrode lines X1 to xi.

The second switch Q32 is switched in response to a control signal (ae) from the timing controller (not shown) during the writing address period of the selective erasing sub-field WSF, to apply the erasing data voltage Vae to the address electrode lines X1 to Xi.

The third switch Q33 is switched in response to a control signal (na) from the timing controller (not shown) during period when the voltage of the address electrode lines X1 to Xi must be sustained at 0V or a ground voltage GND, e.g., reset period or sustaining period etc, to apply the ground voltage GND to the address electrode lines X1 to Xi. The ground voltage GND can be set at 0V or other voltage.

Each of switches shown in FIGS. 10 to 12 can consist of a plurality of switches in accordance with voltage property and current property of the switching device.

As described above, a driving method and apparatus of the PDP according to the present invention, one frame is divided into the sub-fields driven by the selective writing system and the sub-fields driven by the selective erasing system without a entire writing period. Accordingly, the address period is considerably shortened in comparison to the selective writing system, so that the sustaining period can be sufficiently assured. And because it is possible to drive at a high speed, it is advantageous in driving a panel with high resolution. Also, in the present PDP driving method and apparatus, because the period when a discharge is generated in a non-display period is minimized, the contrast ratio is improved so that it is possible to increase definition of a displayed picture. Also, the driving method and apparatus according to the embodiment of the present invention have the scanning voltage and/or the data voltage set differently in the selective writing sub-field and the selective erasing sub-field that have different discharge property from each other to make the driving margin big in both the selective writing sub-field and the selective erasing sub-field and to make it possible to be operated stable even in the high temperature environment. Furthermore, according to the driving method and apparatus of the PDP, the pulse width of the last sustaining pulse of the previous sub-field for initializing the selective erasing sub-field is set wider as compared with the normal sustaining pulse different therefrom so that the driving margin upon the selective erasing not only widens, but the initialization for the selective erasing is also made to be stable.

Although the present invention has been explained by the embodiments shown in the drawings described above, it should be understood to the normal skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display panel that selects cells using selective writing sub-fields and selective erasing sub-fields arranged within one frame period and has a plurality of scanning electrodes, a plurality of sustaining electrodes and a plurality of address electrodes, comprising:

selecting an on-cell by generating a writing discharge based on a first scanning voltage in at least one of the selective writing sub-fields; and selecting an off-cell by generating an erasing discharge based on a second scanning voltage in at least one of the selective erasing sub-fields.

2. The method according to claim 1, wherein the selective writing sub-fields are arranged before the selective erasing sub-fields.

3. The method according to claim 1, wherein at least one of the selective erasing sub-fields is arranged between two of the selective writing sub-fields.

4. The method according to claim 1, wherein at least one of the selective writing sub-fields includes:

a reset period for initializing the plasma display panel;

a writing address period for selecting the on-cell;

a sustaining period for causing a sustaining discharge for the on-cell; and a post-erasure period for eliminating electric charge generated by the sustaining discharge.

5. The method according to claim 4, wherein a last selective writing sub-field adjacent to one of the selective erasing sub-fields has the post-erasure period omitted.

6. The method according to claim 4, wherein at least one of the selective erasing sub-fields includes:

an erasing address period for selecting the off-cell; and a sustaining period for causing a sustaining discharge for the on-cell.

7. The method according to claim 6, wherein a last selective erasing sub-field adjacent to one of the selective writing sub-fields is arranged after the sustaining period, and further includes:

a post-erasure period for eliminating electric charge generated by the sustaining discharge.

8. The method according to claim 6, further comprising:

alternately applying sustaining pulses making the discharge of the on-cells sustained to the scanning electrode and the sustaining electrode during the sustaining period.

9. The method according to claim 8, wherein a first generated sustaining pulse has a pulse width wider than sustaining pulses generated thereafter.

10. The method according to claim 8, wherein after a first sustaining pulse is applied to the sustaining electrode, additional sustaining pulses are alternately applied to the scanning electrode and the sustaining electrode, and a last sustaining pulse is applied to the scanning electrode.

11. The method according to claim 4, wherein, in the reset period, the plasma display panel is initialized by:

applying a ramp signal with a rising gradient and a ramp signal with a descending gradient to the scanning electrode; and applying a first DC voltage to the sustaining electrode while the ramp signal with the descending gradient is applied to the scanning electrode.

12. A The method according to claim 11, wherein, in the writing address period, the on-cell is selected by:

applying the first scanning voltage to the scanning electrode;

applying a data voltage to the address electrode; and applying a second DC voltage that is different from the first DC voltage to the sustaining electrode.

13. The method according to claim 12, wherein the first DC voltage is higher than the second DC voltage.

14. The method according to claim 4, further comprising:

alternately applying sustaining pulses making the discharge of the on-cells sustained to the scanning electrode and the sustaining electrode during the sustaining period.

15. The method according to claim 14, wherein a first generated sustaining pulse has a pulse width wider than sustaining pulses generated thereafter.

16. The method according to claim 14, wherein after a first sustaining pulse is applied to the scanning electrode, additional sustaining pulses are alternately applied to the sustaining electrode and the scanning electrode, and a last sustaining pulse is applied to the scanning electrode.

17. The method according to claim 4, wherein in the post-erasure period, electric charge is eliminated by:

applying a ramp signal having a voltage which gradually ascends to at least one of the scanning electrode and the sustaining electrode.

18. The method according to claim 1, wherein a gray level value is expressed by a combination of the selective writing sub-fields and the selective erasing sub-fields, and parts of the gray level values are expressed by at least any one of a Dithering technique and an error diffusion technique.

19. The method according to claim 18, wherein the first scanning voltage is higher than the second scanning voltage.

20. The method according to claim 1, wherein a swing width of the first scanning voltage is wider than a swing width of the second scanning voltage.

21. The method according to claim 1, wherein the on-cell is selected by:

applying the first scanning voltage to the scanning electrode; and applying a first data voltage to the address electrode.

22. The method according to claim 21, wherein the off-cell is selected by:

applying the second scanning voltage to the scanning electrode; and applying a second data voltage to the address electrode.

23. The method according to claim 22, wherein a first data pulse for applying the first data voltage and a second data pulse for apply the second data voltage are different in at least one of a pulse width and a voltage level.

24. The method according to claim 1, wherein a first scanning pulse for applying the first scanning voltage and a second scanning pulse for applying the second scanning voltage are different in at least one of a pulse width and a voltage level.

25. A method of driving a plasma display panel that selects cells using selective writing sub-fields and selective erasing sub-fields arranged within one frame period, sustains a discharge for the selected cells using a sustaining pulse, and has a plurality of scanning electrodes, a plurality of sustaining electrodes and a plurality of address electrodes, comprising:

setting an erasing initialization pulse with a pulse width wider than the sustaining pulse; and applying the erasing initialization pulse to the plasma display panel before the selective erasing sub-fields.

26. The method according to claim 25, wherein the selective writing sub-fields are arranged before the selective erasing sub-fields.

27. The method according to claim 25, wherein at least one of the selective erasing sub-fields is arranged between two of the selective writing sub-fields.

28. The method according to claim 25, wherein at least one of the selective writing sub-fields includes:

a reset period for initializing the plasma display panel;

a writing address period for selecting an on-cell;

a sustaining period for causing a sustaining discharge for the on-cell; and a post-erasure period for eliminating electric charge generated by the sustaining discharge.

29. The method according to claim 28, wherein a last selective writing sub-field adjacent to one of the selective erasing sub-fields has the post-erasure period omitted.

30. The method according to claim 28, wherein at least one of the selective erasing sub-fields includes:

an erasing address period for selecting an off-cell; and a sustaining period for causing a sustaining discharge for the on-cell.

31. The method according to claim 30, wherein a last selective erasing sub-field adjacent to one of the selective writing sub-fields is arranged after the sustaining period; and further includes:

a post-erasure period for eliminating electric charge generated by the sustaining discharge.

32. The method according to claim 31, wherein, in the writing address period, the on-cell is selected by:

applying the first scanning voltage to the scanning electrode;

applying a data voltage synchronized with the first scanning voltage to the address electrode; and applying a second DC voltage that is different from the first DC voltage to the sustaining electrode.

33. The method according to claim 32, wherein the first DC voltage is higher than the second DC voltage.

34. The method according to claim 28, wherein, in the reset period, the plasma display panel is initialized by:

applying a ramp signal with a rising gradient and a ramp signal with a descending gradient to the scanning electrode of the plasma display panel; and applying a first DC voltage to the sustaining electrode while the ramp signal with the descending gradient is applied to the scanning electrode.

35. The method according to claim 25, wherein a start sustaining pulse first generated every sub-field has it's a pulse width wider than sustaining pulses generated thereafter.

36. A method of driving a plasma display panel that selects cells using selective writing sub-fields and selective erasing sub-fields arranged within one frame period, sustains a discharge for the selected cells using a sustaining pulse, and has a plurality of scanning electrodes, a plurality of sustaining electrodes and a plurality of address electrodes, comprising:

setting an erasing initialization pulse with a voltage higher than the sustaining pulse; and applying the erasing initialization pulse to the plasma display panel before the selective erasing sub-fields.

37. A driving apparatus of a plasma display panel that selects cells using selective writing sub-fields and selective erasing sub-fields arranged within one frame period, and has a plurality of scanning electrodes, a plurality of sustaining electrodes and a plurality of address electrodes, comprising:

a first scanning circuit which selects an on-cell by applying a first scanning voltage to a scanning electrode to generate a writing discharge in at least one of the selective writing sub-fields; and a second scanning circuit which selects an off-cell among one or more on-cells by applying a second scanning voltage, which is different from the first scanning voltage, to the scanning electrode to generate an erasing discharge in at least one of the selective erasing sub-fields.

38. The driving apparatus according to claim 37, wherein a swing width of the first scanning voltage is wider than a swing width of the second scanning voltage.

39. The driving apparatus according to claim 37, wherein the first scanning voltage is higher than the second scanning voltage.

40. The driving apparatus according to claim 37, further including:

a first address circuit which applies a first data voltage to the address electrode in said at least one selective writing sub-field.

41. The driving apparatus according to claim 40, further including:

a second address circuit which applies a second data voltage to the address electrode in said at least one selective erasing sub-field.

42. The driving apparatus according to claim 41, wherein a first data pulse for applying the first data voltage and a second data pulse for apply the second data voltage are different in at least any one of a pulse width or a voltage level.

43. The driving apparatus according to claim 37, wherein the first scanning circuit and the second scanning circuit apply a ramp signal with a rising gradient and a ramp signal with a descending gradient to the scanning electrode during a reset period of at least one of the selective writing sub-fields for initializing the cells.

44. The driving apparatus according to claim 43, further including:

a sustaining circuit for applying a first DC voltage to a sustaining electrode while the ramp signal with the descending gradient is applied to the scanning electrode.

45. The driving apparatus according to claim 44, wherein the sustaining circuit applies a second DC voltage, which is different from the first DC voltage, to the sustaining electrode during a writing address period of at least one of the selective writing sub-fields for selecting the on-cell.

46. The driving apparatus according to claim 45, wherein the first DC voltage is higher than the second DC voltage.

47. The driving apparatus according to claim 44, wherein the scanning circuits and the sustaining circuit alternately apply a sustaining pulse for sustaining a discharge of the selected on-cell in the selective writing sub-fields and the selective erasing sub-fields, respectively.

48. The driving apparatus according to claim 47, wherein a sustaining pulse first generated among sustaining pulses has it's a pulse width wider than sustaining pulse generated thereafter.

49. The driving apparatus according to claim 47, wherein the scanning circuits and the sustaining circuit apply a ramp signal having it's a voltage which gradually ascends to at least one of the scanning electrode and the sustaining electrode after applying the sustaining pulse in at least one of the selective writing sub-fields.

50. The driving apparatus according to claim 37, wherein the first and second scanning circuits generate a first scanning pulse for applying the first scanning voltage and a second scanning pulse for applying the second scanning voltage, and the first and second scanning pulses are different in at least one of a pulse width and a voltage level.

51. A driving apparatus of a plasma display panel that selects cells using selective writing sub-fields and selective erasing sub-fields arranged within one frame period, sustains a discharge for the selected cells using a sustaining pulse, and has a plurality of scanning electrodes, a plurality of sustaining electrodes and a plurality of address electrodes, comprising:

a first scanning/address circuit which selects on-cells using a writing discharge in at least one of the selective writing sub-fields;

a second scanning/address circuit which selects an off-cell among the on-cells using an erasing discharge in at least one of the selective erasing sub-fields; and a sustaining circuit which applies the sustaining pulse to the selected on-cells to sustain a discharge of the on-cells, and applies an erasing initialization pulse that has it's a pulse width wider than the sustaining pulse before the selective erasing sub-fields.

52. The driving apparatus according to claim 51, wherein the sustaining circuit generates the erasing initialization pulse with a pulse width of about 20~50 μs.

53. A driving apparatus of a plasma display panel that selects cells using selective writing sub-fields and selective erasing sub-fields arranged within one frame period, sustains a discharge for the selected cells using a sustaining pulse, and has a plurality of scanning electrodes, a plurality of sustaining electrodes and a plurality of address electrodes, comprising:

a first scanning/address circuit which selects on-cells using a writing discharge in at least one of the selective writing sub-fields;

a second scanning/address circuit which selects an off-cell among the on-cells using an erasing discharge in at least one of the selective erasing sub-fields; and a sustaining circuit which applies the sustaining pulse to the selected on-cells to sustain a discharge of the on-cells, and applies an erasing initialization pulse that has it's a voltage higher than the sustaining pulse before the selective erasing sub-fields.

54. The driving apparatus according to claim 53, wherein the sustaining circuit generates the erasing initialization pulse with a voltage of about 170~185V.

55. A method for driving a plasma display panel for image display comprising:

establishing an address period associated with a corresponding subfield of a field to activate a cell of the plasma display panel on the basis of a specified address and a sustained discharge period with discharge produced for a specified number of times;

assigning a first light-emitting subfield group comprising two or more subfields, at least two of said subfields being selective erasing subfields and having sustained discharge periods having sustain pulses of different durations; and emitting light having an intensity level based on an aggregate duration of sustain pulses for the subfields forming said first light-emitting subfield group.

56. The method of claim 55, wherein only one of the selective erasing subfields includes a post erasure period.

57. The method of claim 55, further comprising:

a second light-emitting subfield group included with the first light-emitting subfield group within a same frame, said second light-emitting subfield group including a number of selective writing subfield pulses, wherein at least one of the selective writing subfield pulses includes a post erasure period and at least one other selective writing subfield does not include a post erasure period.

58. A method for driving a display panel for image display comprising:

assigning an address period associated with a corresponding subfield of a field on the basis of a specified address and a sustained discharge period;

assigning a light-emitting subfield group comprising first to nth subfields having sustained discharge periods having sustain pulses of substantially equal aggregate duration, wherein n is greater than or equal to two;

establishing a write address period for selectively accumulating wall charge on a dielectric covering an electrode in a write-addressed display cell, during a write address period of said first subfield;

continuously emitting light for each following subfield within the subfield group until canceled; and establishing an erase address period for selectively erasing the wall charge accumulated on said dielectric in an erase-addressed non-display cell during an erase address period set in a subfield following said nth subfield, the erasing canceling the continuous emission of light during the subfield group, wherein the subfield following said nth subfield and another subfield either in or following the subfield group within a same frame have sustain periods of different durations.

59. A method for driving a plasma display panel comprising:

establishing discharge periods associated with corresponding subfields of a field;

assigning a subfield group including a plurality of subfields within said subfield group, each of said subfields developing at least one sustain pulse having a sustained discharge period, at least two of said subfields being selective erasing subfields having sustain pulses of different duration; and emitting light having an intensity level based on an aggregate discharge period for all of the subfields forming the assigned subfield group.

* * * * *